US006549169B1

(12) United States Patent
Matsuyoshi et al.

(10) Patent No.: US 6,549,169 B1
(45) Date of Patent: Apr. 15, 2003

(54) ANTENNA FOR MOBILE WIRELESS COMMUNICATIONS AND PORTABLE-TYPE WIRELESS APPARATUS USING THE SAME

(75) Inventors: Toshimitsu Matsuyoshi, Katano (JP); Koichi Ogawa, Hirakata (JP); Hiroshi Iwai, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 35 days.

(21) Appl. No.: 09/691,283

(22) Filed: Oct. 18, 2000

(30) Foreign Application Priority Data

Oct. 18, 1999 (JP) ..... 11-295444

(51) Int. Cl.[7] ..... H01Q 1/24; H01Q 1/48
(52) U.S. Cl. ..... 343/702; 343/767; 343/846
(58) Field of Search ..... 343/700 MS, 702, 343/745, 846, 853, 767, 770, 850

(56) References Cited

U.S. PATENT DOCUMENTS

| | | | | | |
|---|---|---|---|---|---|
| 5,229,777 | A | * | 7/1993 | Doyle | 343/700 MS |
| 5,231,407 | A | * | 7/1993 | McGirr et al. | 343/700 MS |
| 5,786,793 | A | * | 7/1998 | Maeda et al. | 343/700 MS |
| 5,966,096 | A | * | 10/1999 | Brachat | 343/700 MS |
| 5,977,916 | A | * | 11/1999 | Vannatta et al. | 343/702 |
| 6,295,030 | B1 | * | 9/2001 | Kozakai et al. | 343/700 MS |

* cited by examiner

*Primary Examiner*—Hoang Nguyen
(74) *Attorney, Agent, or Firm*—RatnerPrestia

(57) ABSTRACT

An antenna for mobile wireless communications in which two built-in antennas 101, 102 having a bisymmetric shape arranged in an axi-symmetric location of a ground plate 105 and, by feeding both of the antennas by using a balanced-to-unbalanced conversion circuit 106 at the same amplitude and the phase difference of 180 degrees, balanced operations are performed.

32 Claims, 23 Drawing Sheets

FIG. 8A
switch at off time
FIG. 8B
switch at on time
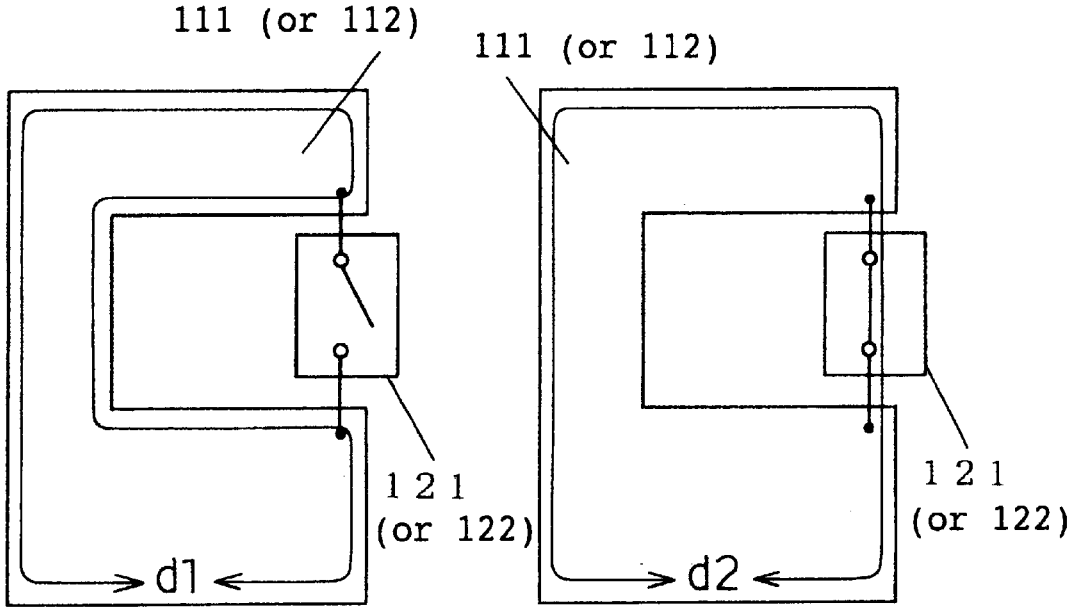
Resonance frequency f1
Resonance frequency f2
FIG. 8C
f1 < f2
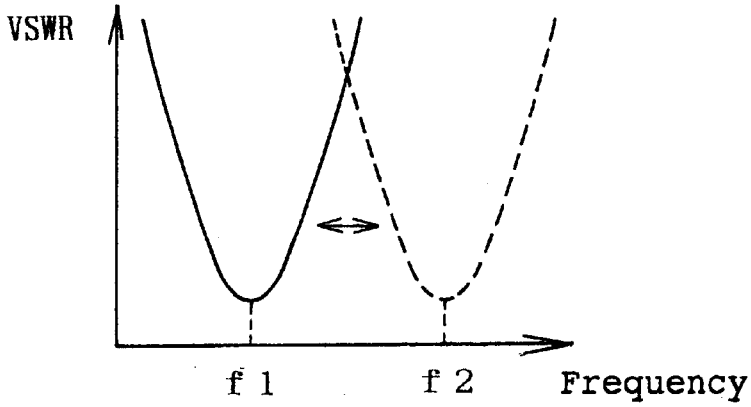

the case of frequency f3

Resonates at f3 the case of frequency f4

Resonates at f4 f 3 < f 4 the case of frequency f5

Resonates at f5 the case of frequency f6

Resonates at f6 f5<f6

ANTENNA FOR MOBILE WIRELESS COMMUNICATIONS AND PORTABLE-TYPE WIRELESS APPARATUS USING THE SAME

BACKGROUND OF THE INVENTION

1. Field of the Invention

The present invention relates to an antenna for mobile wireless communications mainly used by a portable telephone or the like, and to a portable-type wireless apparatus.

2. Description of the Related Art

In recent years, technology relating to the portable telephone or the like has rapidly been developing. In a portable telephone terminal, an antenna is one of specially important devices and, accompanied by the miniaturization of the terminal, the antenna is also required to be miniaturized and built-in.

One example of the above described conventional antenna for mobile wireless communications will be described with reference to the accompanied drawing.

The conventional antenna for mobile wireless communications is shown in FIG. 21. 201 is a planar antenna element, 202 a feeding point, 203, 204 metal wires and 205 a conductive ground plate. The antenna element 201 is fed from a feeding point 202 via the metal wire 203. Also, the antenna element 201 is connected to the conductive ground plate 205 via the metal wire 204.

This is usually referred to as Planar Inverted F Antenna PIFA and used in a portable terminal as a short and small size antenna. The radiation characteristic thereof is shown in FIG. 22.

However, since the above described configuration results in an unbalanced-type antenna, a large current flows into the ground plate 205 forming a body of apparatus, which acts as an antenna. A drawing typically showing the current at this time is shown in FIG. 23. In this case, when the human body grips the body of apparatus, the input impedance of the antenna is changed greatly so that the radiation characteristics are deteriorated.

SUMMARY OF THE INVENTION

In view of the problems in the above described conventional antenna, an object of the present invention is to provide an antenna for mobile wireless communications and a portable-type wireless apparatus using the same in which the current of the body of apparatus is reduced and the effect of the human body on the radiation characteristics is minimized much more.

One aspect of the present invention is an antenna for mobile wireless communications, comprising two antennas, wherein feeding phases for said two antennas are substantially different with each other.

Another aspect of the present invention is the antenna for mobile wireless communications, wherein the difference of the feeding phases between said two antennas is substantially 180 degrees.

Still another aspect of the present invention is the antenna for mobile wireless communications, wherein said two antennas are arranged in close vicinity to an ground plate.

Yet another aspect of the present invention is the antenna for mobile wireless communications, wherein said two antennas are of the same shape, and moreover, the ambient lengths of the respective two antennas are either the same or different with each other.

Still yet another aspect of the present invention is the antenna for mobile wireless communications, wherein said two antennas are arranged in the location where they become substantially axi-symmetric.

A further aspect of the present invention is the antenna for mobile wireless communications, comprising feeding points connected to each antenna, wherein each of said two antennas is in the shape of a polygon or a circle and each of said two antennas is configured by a metal plate electrically short-circuited with said ground plate at least at one place.

A still further aspect of the present invention is the antenna for mobile wireless communications, comprising the feeding points connected to each antenna, wherein each of said two antennas is in the shape of a polygon or a circle and each of said two antennas is configured by the metal plates electrically short-circuited with said ground plate at least at one place.

A yet further aspect of the present invention is the antenna for wireless communications, wherein slits are disposed with said metal plates at least at one place.

A still yet further aspect of the present invention is the antenna for wireless communications, wherein a switching circuit capable of electrically connecting an open end of the slit is connected to said slit.

An additional aspect of the present invention is the antenna for mobile wireless communications, wherein said switching circuit is configured by a series resonance circuit.

A sill additional aspect of the present invention is the antenna for mobile wireless communications, wherein said switching circuit is configured by a parallel resonance circuit.

A yet additional aspect of the present invention is the antenna for mobile wireless communications, wherein said two antenna are formed on a dielectric substrate.

A still yet additional aspect of the present invention is an antenna for mobile wireless communications, comprising:

a conductive ground plate of a substantially rectangular shape;

a dielectric substrate arranged on said conductive ground plate in close vicinity to the other end portion side of said both end portions with the center location of the longitudinal conductive ground plate as a basis; and two antenna elements of a substantially rectangular shape formed on said dielectric substrate, wherein each of said two antennas has a feeding point and at least one through-hole and is electrically short-circuited with said conductive ground plate by the through-hole.

Another aspect of the present invention is the antenna for mobile wireless communications, wherein the difference of the feeding phases for said two antenna elements is substantially 180 degrees.

Still another aspect of the present invention is the antenna for mobile wireless communications, wherein said two antenna elements are substantially of an axi-symmetric structure.

Yet another aspect of the present invention is the antenna for mobile wireless communications, wherein each said feeding point and each said through-hole is arranged at the location where either of them becomes axi-symmetric.

Still yet another aspect of the present invention is the antenna for mobile wireless communications, wherein a distance between said two antennas or a distance between said two antenna elements is a length not greater than one-tenth of a wavelength corresponding to a length which is substantially two times an ambient length of each said antenna or each said antenna element.

A further aspect of the present invention is the antenna for mobile wireless communications, wherein each said feeding point and each said through-hole is arranged in the location where either of them becomes axi-symmetric.

A yet further aspect of the present invention is the antenna for mobile wireless communications, wherein a distance between said two antennas or a distance between said two antenna elements is a length not greater than one-tenth of a wavelength corresponding to a length which is substantially two times an ambient length of each said antenna or each said antenna element.

A still yet a further aspect of the present invention is the antenna for mobile wireless communications, wherein each said feeding point and each said through-hole is arranged at the location where either of them becomes axi-symmetric.

An additional aspect of the present invention is the antenna for mobile wireless communications, wherein a distance between said two antennas or a distance between said two antenna elements is a length not greater than one-tenth of a wavelength corresponding to a length which is substantially two times an ambient length of each said antenna or each said antenna element.

A still additional aspect of the present invention is the antenna for mobile wireless communications, further comprising a balance-to-unbalance circuit for feeding said two antennas or said two antenna elements.

A yet additional aspect of the present invention-is the antenna for mobile wireless communications, wherein each said metal plate is of a rectangular shape and each portion in which each of said two metal plates arranged in a substantially axi-symmetric location is electrically short-circuited with said ground plate is inclose vicinity to an outer peripheral portion of said metal plate.

A still yet additional aspect of the present invention is the antenna for mobile wireless communications, wherein each said metal plate is of a rectangular shape and each portion in which each of said two metal plates arranged in a substantially axi-symmetric location is electrically short-circuited with said ground plate is inclose vicinity to the outer peripheral portion of said metal plate.

Another aspect of the present invention is the antenna for mobile wireless communications, wherein said portion is in close vicinity to a side opposite to each of respective sides where said metal plates arranged in said axi-symmetry stand face to face each other and, viewed from said portion, each said antenna is fed from the feeding point in close vicinity to a central portion of said metal plate.

Still another aspect of the present invention is the antenna for mobile wireless communications, wherein said portion is in close vicinity to a side opposite to each of respective sides where said metal plates arranged in said axi-symmetry stand face to face each other and, viewed from said portion, each said antenna is fed from the feeding point in close vicinity to a central portion of said metal plate.

Yet another aspect of the present invention is the antenna for mobile wireless communications, wherein said two antennas are arranged by inclining to one of both sides with the central portion of said ground plate as a basis, and each said portion and each said feeding point is arranged in close vicinity to said one side.

Yet still another aspect of the present invention is the antenna for mobile wireless communications, wherein said two antennas are arranged by inclining to one of both sides with the central portion of said ground plate as a basis, and each said portion and each said feeding point is arranged in close vicinity to said one side.

A further aspect of the present invention is the antenna for mobile wireless communications, wherein said two antennas are formed on a dielectric.

A still further aspect of the present invention is the antenna for mobile wireless communications, wherein said two antennas are formed on the dielectric.

A yet further aspect of the present invention is the antenna for mobile wireless communications inventions, wherein an operating frequency band is above UHF band.

A still yet further aspect of the present invention is the antenna for mobile wireless communications inventions, wherein an operating frequency band is above UHF band.

An additional aspect of the-present invention is the antenna for mobile wireless communications inventions, wherein an operating frequency band is above UHF band.

A still additional aspect of the present invention is a portable-type wireless apparatus, comprising an antenna for mobile wireless communications using said ground plane as a ground plate on a dielectric circuit substrate having a ground plane, wherein said dielectric circuit substrate and said antennas or antenna elements are covered with a case made of resin.

A yet additional aspect of the present invention is a portable-type wireless apparatus, comprising an antenna for mobile wireless communications using said ground plane as a ground plate on a dielectric circuit substrate having a ground plane, wherein said dielectric circuit substrate and said antenna or antenna elements are covered with a case of resin.

A still yet additional aspect of the present invention is a portable-type wireless apparatus, comprising an antenna for mobile wireless communications using said ground plane as a ground plate on a dielectric circuit substrate having a ground plane, wherein said dielectric circuit substrate and said antennas or antenna elements are covered with a case made of resin.

DESCRIPTION OF THE DRAWINGS

FIG. 8A is a type drawing describing operating principles when a switching circuit of the antenna for mobile wireless communications in the fourth embodiment of the present invention is off.

FIG. 8B is a type drawing describing operating principles when the switching circuit of the antenna for mobile wireless communications in the fourth embodiment of the present invention is on.

FIG. 8C is an explanatory drawing of realization of a broad band for the antennas in the fourth embodiments.

Description of Reference Numerals

Figure 1:
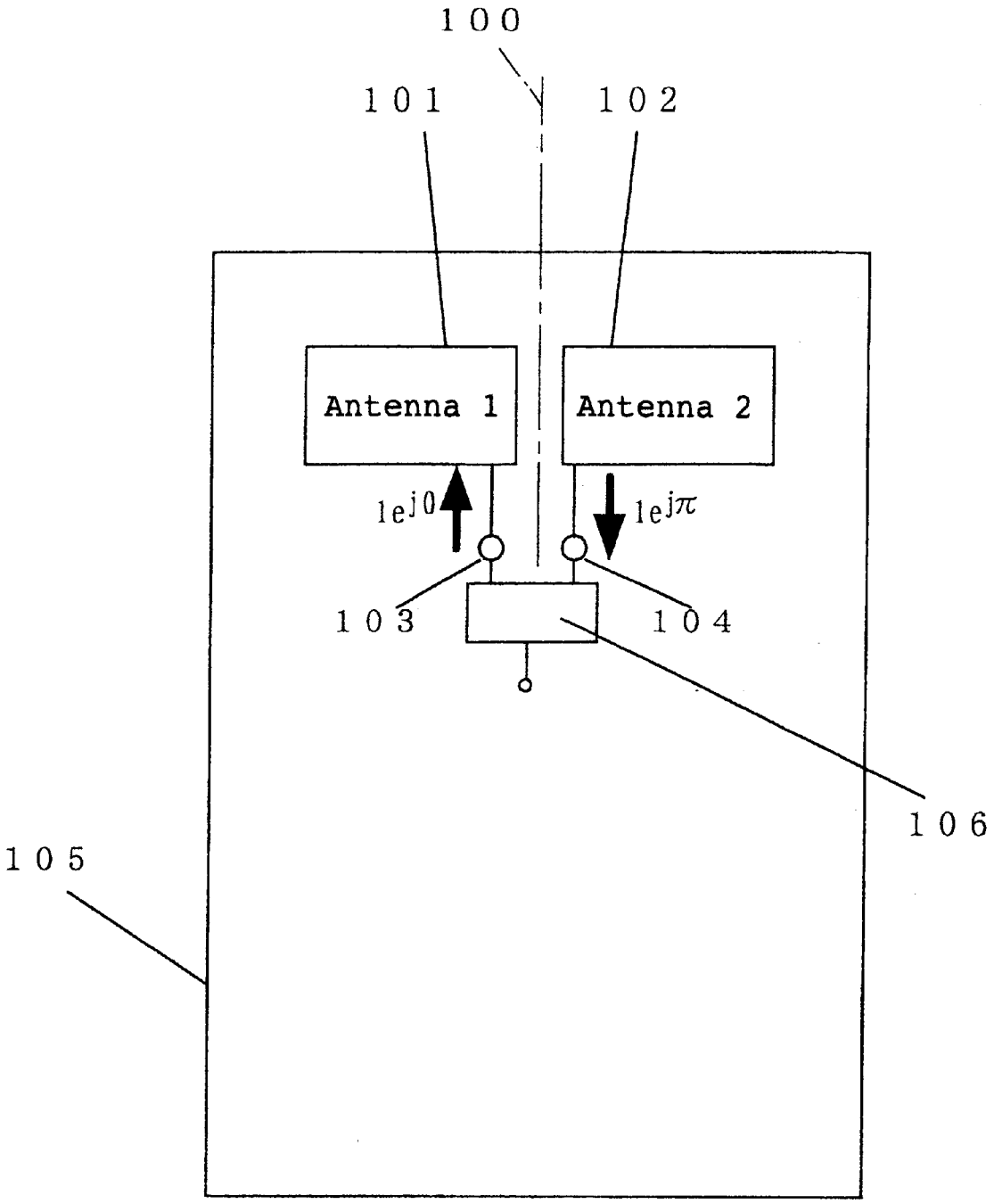
FIG. 1 is an abstract circuit diagram of an antenna for mobile wireless communications in a first embodiment of the present invention.

101, 102 Built-in type antenna
103, 104 Feeding point
105 Conductive ground plate
106 Balanced-to-unbalanced circuit
111, 112 Antenna element
113–116 Metal wire
121, 122 Switching circuit
123 Coil
124 Capacitor
141, 142 Antenna element
143 Dielectric substrate
144 Conductive ground plate
145, 146 Feeding point
147, 148 Through-hole
151 Dielectric circuit substrate
152, 153 Resin case

PREFERRED EMBODIMENTS OF THE INVENTION

First Embodiment

Hereinafter, an antenna for mobile wireless communications in a first embodiment of the present invention will be described with reference to the accompanied drawings.

FIG. 1 abstractly shows a circuit diagram of the antenna for mobile wireless communications in the first embodiment of the present invention.

In FIG. 1, 101, 102 are built-in antennas, 103 is a feeding point of 101, 104 is a feeding point of the antenna 102 and 105 is a conductive ground plate. 101 and 102 are of a bisymmetric shape and arranged axi-symmetrically (a reference line 100 in the drawing serves as an axis of symmetry) on the conductive ground plate 105. Also, these antennas 101, 102 are fed substantially at the same amplitude and moreover substantially at the same phase difference of 180 degrees. For example, in the case where a feeding is made from an unbalanced line such as a coaxial cable or the like, a balanced-to-unbalanced conversion circuit 106 as shown in FIG. 1 is used.

Figure 2:
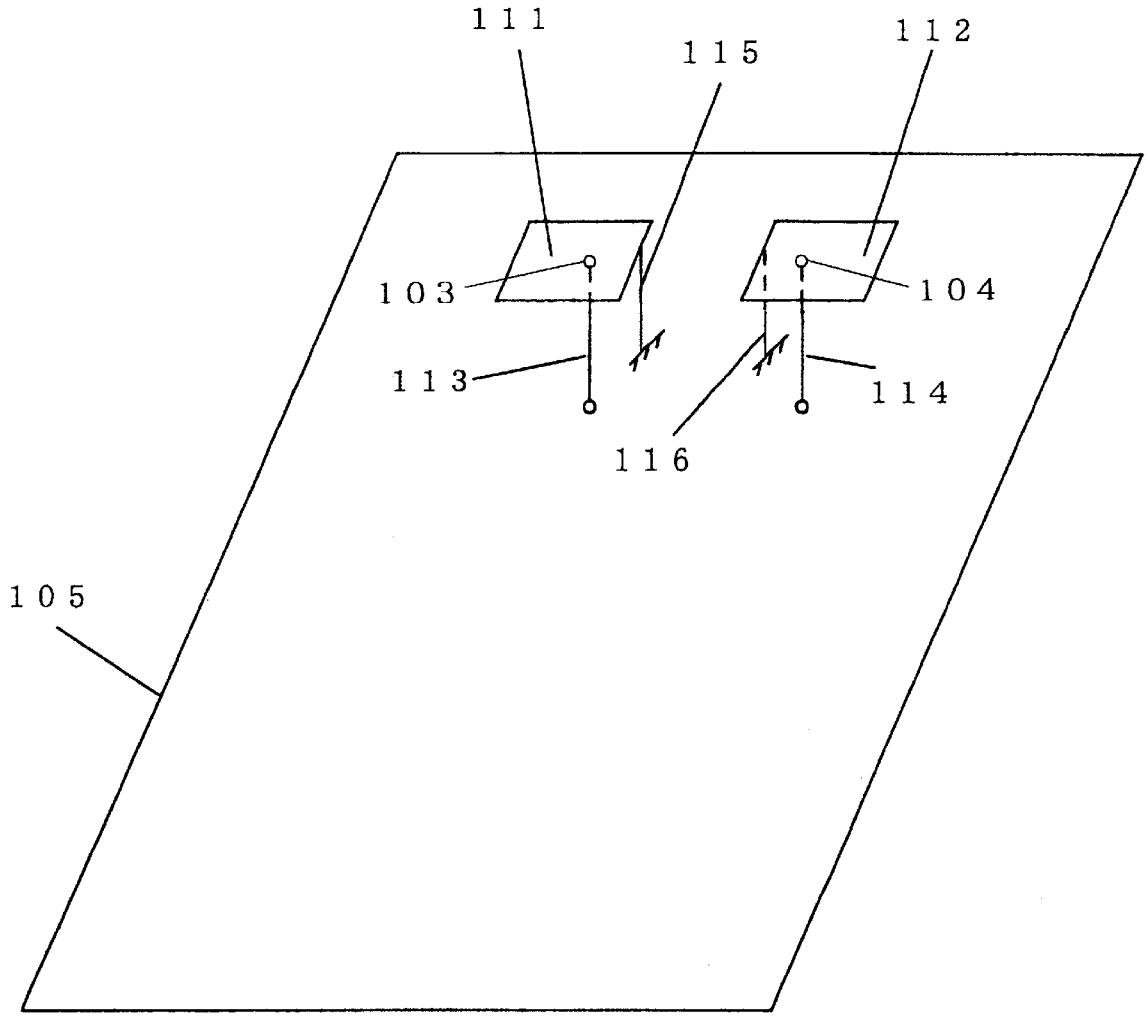
FIG. 2 is a concrete circuit diagram of the antenna for mobile wireless communications in the first embodiment of the present invention.

A drawing concretely showing the circuit diagram of FIG. 1 is shown in FIG. 2. In FIG. 2, 111, 112 are planar antenna elements, 113, 114, 115, 116 are metal wires and 103, 104 are feeding points. The feeding point 103 of the antenna element 111 is connected to the balanced-to unbalanced circuit 106 via the metal wire 113. Also, the antenna element 111 is connected to the conductive ground plate 105 via the metal wire 115. Also, the feeding point 104 of the planar antenna element 112 is connected to the balanced-to-unbalanced circuit 106 via the metal wire 114. Also, the antenna element 112 is connected to the conductive ground plate 105 via the metal wire 116.

The antenna 101 of FIG. 1 is configured by the antenna element 111 and the metal wires 113, 115 of FIG. 2.

Similarly the antenna 102 is configured by the antenna element 112 and the metal wires 114, 116. For example, a metal plate of a rectangular shape is used as the antenna elements 111, 112 and the conductive ground plate 105 is configured by a metal plate such as a copper plate or the like.

Next, the operating principles of the present embodiment will be described.

The two antennas 101, 102 having a symmetric configuration in the present embodiment are arranged axi-symmetrically on the ground plate 105. That is, the antenna 101 and the antenna 102 are of a axi-symmetric structure with an axis of symmetry 100 in the drawing as a basis and configured so as to have substantially the same area and the same ambient length (which is represented by L).

Also, in the antennas of the present embodiment, a balanced feeding is made at the feeding points 103 and 104. The balanced feeding is usually made by using the balanced-to-unbalanced circuit 106 as shown in FIG. 1.

Because of such a feeding method as above, the current flowing to the antennas 101, 102 is not attributable to the shape and the size of the ground plate 105 or the location where the antennas 101, 102 are arranged, but almost all current flows into the antenna elements 111, 112, while almost no current flows into the ground plate 105 forming a body of apparatus. For this reason, even if the human body holds the body of apparatus, the change in the input impedance of the antennas 101, 102 remains small.

As a result, even if the human body holds the body of apparatus, the impedance matching between the antennas 101, 102 and a transmit-receive circuit connected the antennas 101, 102 does not drift, thereby enabling to control the deterioration of the radiation characteristics.

As described above, by making the balanced feeding by using the two built-in antennas having a symmetric structure like the present embodiment, the current of the body of apparatus which causes the deterioration of the radiation characteristics when the human body holds the body of apparatus is reduced, thereby controlling the deterioration of the radiation characteristics by the human body.

As a result, the built-in antennas reducing the effect of the human body can be realized.

Moreover, in the present embodiment, by drawing the intervals between the two antennas 101, 102 (the antenna elements 111, 112) near to a distance not greater than 10% (0.2L) of the length 2L (a length corresponding to the wavelength λ) which is substantially two times the ambient length L of the antennas 101, 102 , a floating capacity between both the antennas is increased.

Figure 3A:
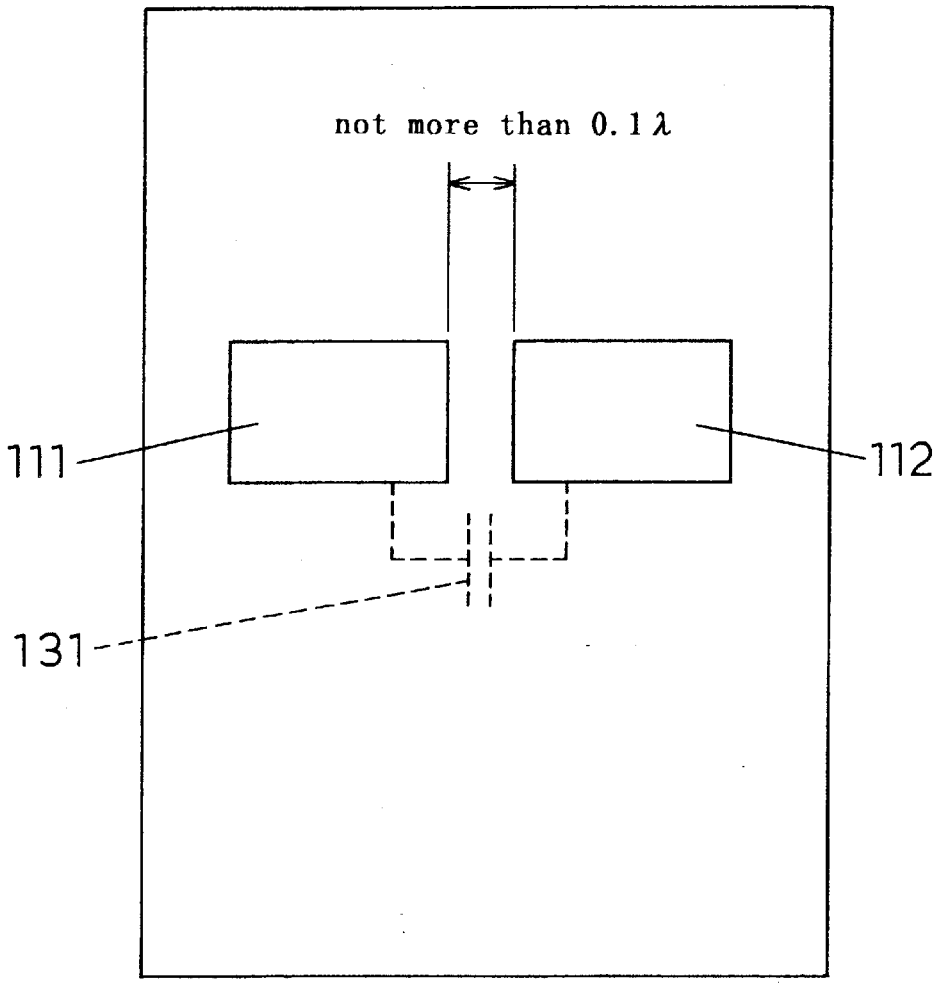
FIG. 3A is a drawing showing the case where the distance between the antennas is narrow for the antenna for mobile wireless communications in the first embodiment of the present invention.
Figure 3B:
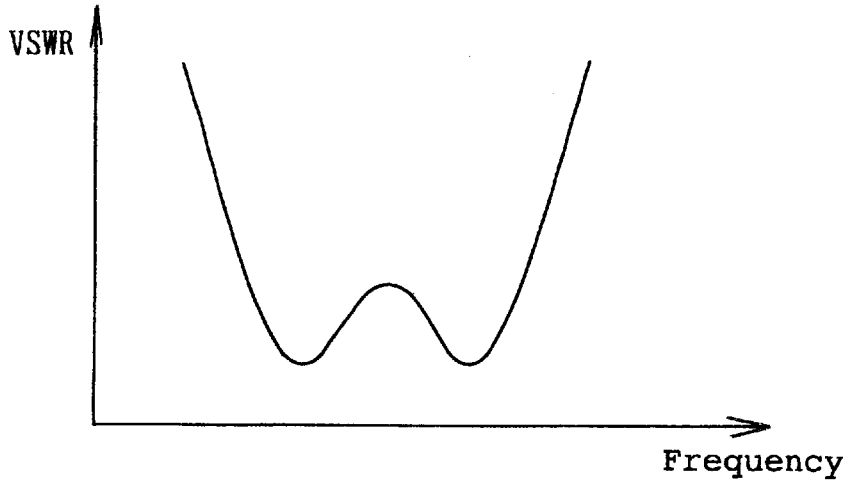
FIG. 3B is a drawing showing resonance frequency characteristics in FIG. 3A.

This state is shown in FIG. 3A. 131 is the floating capacity. With the capacity generated between the two antennas having the same resonance frequency, a double resonance develops acting as balanced antennas as shown in FIG. 3B so that the broad band for the antennas can be realized. Here, FIG. 3B is a drawing showing the resonance frequency characteristics in the configuration as shown in FIG. 3A. Further, in FIG. 3B, the coordinates axis is VSWR (a voltage stabilizing wave ratio).

Moreover, in the present embodiment, a metal plate in the shape of a rectangle is used for the antenna elements 111 and 112. However, even if a metal plate in the shape of other than a polygon or a circle is used, the same effect can be obtained.

Also, in the present embodiment, the two antennas 101 and 102 are arranged on the conductive ground plate 105. However, even without the conductive ground plate, they are operated as the antennas by means of the balanced feeding and therefore can be configured so as not to be arranged on the conductive ground plate.

By being configured in such manner, the configuration in which the conductive ground plate required in the past is removed can be realized so that the antennas can be designed to be more compact in size and light in weight.

Further, in case of the configuration without the above described conductive ground plate or in the case where the conductive ground plate is disposed but electrically not connected to the antennas, the size of the antennas is required to be two times that of the above described case. The relation between the ambient length L' of the antennas and the resonance wavelength λ in this case is represented by L'=λ. Such a configuration is effective, for example, in the case where an electrical connection between the conductive ground plate and antennas is difficult.

Also, in the present embodiment, the antennas 101, 102 are arranged axi-symmetrically. However, without being arranged in such manner, balanced operations are performed so that the same effect can be obtained.

Also, in the present embodiment, the metal wires 115, 116 are used for connecting the antenna elements 111 and 112 to the conductive ground plate 105. However, the connection can be made by using metal plates also.

Even by being configured in such manner, not only the same effect can be obtained, but also a structural strength can be increased.

Also, the resonance frequency can be changed according as the metal wire is grounded or the metal plate is grounded.

Also, in the present embodiment, the antenna element is electrically grounded at one place. However, it may be also grounded at several places. The electrical grounding at a plurality of places can realize the broad band for the antennas.

Also, in the present embodiment, the antennas 101 and 102 are configured by the antenna elements made of metal plates and the metal wires. However, they can be configured also by the antennas formed with dielectric substrates or chip antennas configured by laminating dielectrics. By using dielectrics, further miniaturization can be effected (refer to FIG. 13).

Moreover, in the present embodiment, the conductive ground plate 105 is configured by the metal plate such as a copper plate or the like. However, even if it is configured by the dielectric substrate having a ground layer, the same effect can be obtained (refer to FIG. 20).

Second Embodiment

Next, an antenna for mobile wireless communications in a second embodiment of the present invention will be described with reference to the accompanied drawings.

Figure 4:
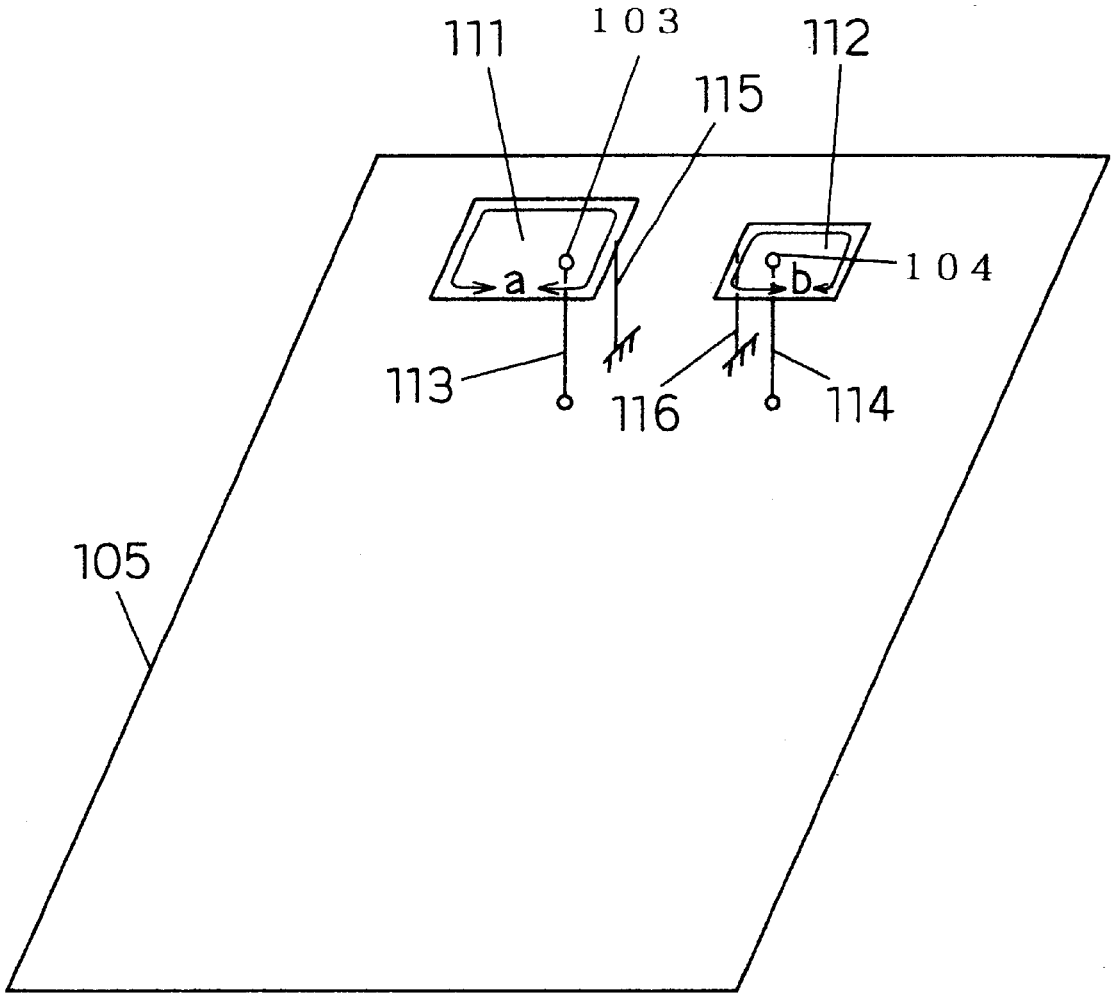
FIG. 4 is a concrete circuit diagram of the antenna for mobile wireless communications in a second embodiment of the present invention.

The abstract circuit diagram of the present embodiment is the same with FIG. 1. FIG. 4 shows a concrete circuit diagram of the antenna for mobile wireless communications in the second embodiment of the present invention.

In FIG. 4, the same reference numerals with FIG. 2 are used for the same components with the first embodiment and, therefore, the description thereof is omitted.

The present embodiment is different from the first embodiment in that if the ambient length of the antenna element 111 forming an antenna 1 is represented by a and the ambient length of the antenna element 112 forming an antenna 2 by b, the length of a and b is different with each other.

The antennas of the present embodiment resonate with the wavelengths corresponding to the lengths substantially two times the ambient lengths of the antenna elements.

Accordingly, by making the ambient lengths of the two antennas different with each other, the resonance frequencies of both antennas can be shifted. Thus in this manner, the broad-band for flat-inverted-F antennas can be realized.

To be concrete, if the differences between a and b are not greater than 10% of b, the balanced feeding does not collapse so that the broad band can be realized.

Moreover, in the present embodiment, the two antennas 101, 102 are arranged on the conductive ground plate 105. However, similar to the first embodiment, they can be also configured so as not to be arranged on the conductive ground plate.

By being configured in such manner, the configuration in which the conductive ground plate required in the past is removed can be realized so that the antennas can be designed to be more compact in size and light in weight.

Also, in the present embodiment, the antennas 101 and 102 are arranged axi-symmetric. However, without being arranged in such manner, balanced operations are performed so that the same effect can be obtained.

Also, the effect of the antennas of the present embodiment, that is, the effect that the resonance frequencies can be changed can be realized by changing the physical relationship between the feeding points and the ground plate metal wires even by using the antenna elements of the same ambient length.

In the present embodiment, the broad band is realized by making different the ambient lengths of the two antennas. However, the broad band can be realized also by changing the physical relationship between the feeding points and ground plate metal wires with the ambient lengths of the two antennas made equal to each other.

Also, in the present embodiment, similar to the first embodiment, the rectangular metal plates are used for the antenna elements 111, 112. However, even if the metal plates in other shape such as a polygon or a circle are used, the same effect can be obtained.

Moreover, in the present embodiment, similar to the first embodiment, the broad band for the antennas can be realized by narrowing the intervals between the two antennas.

Third Embodiment

Next, an antenna for mobile wireless communications in the third embodiment of the present invention will be described with the accompanied drawings.

Figure 5:
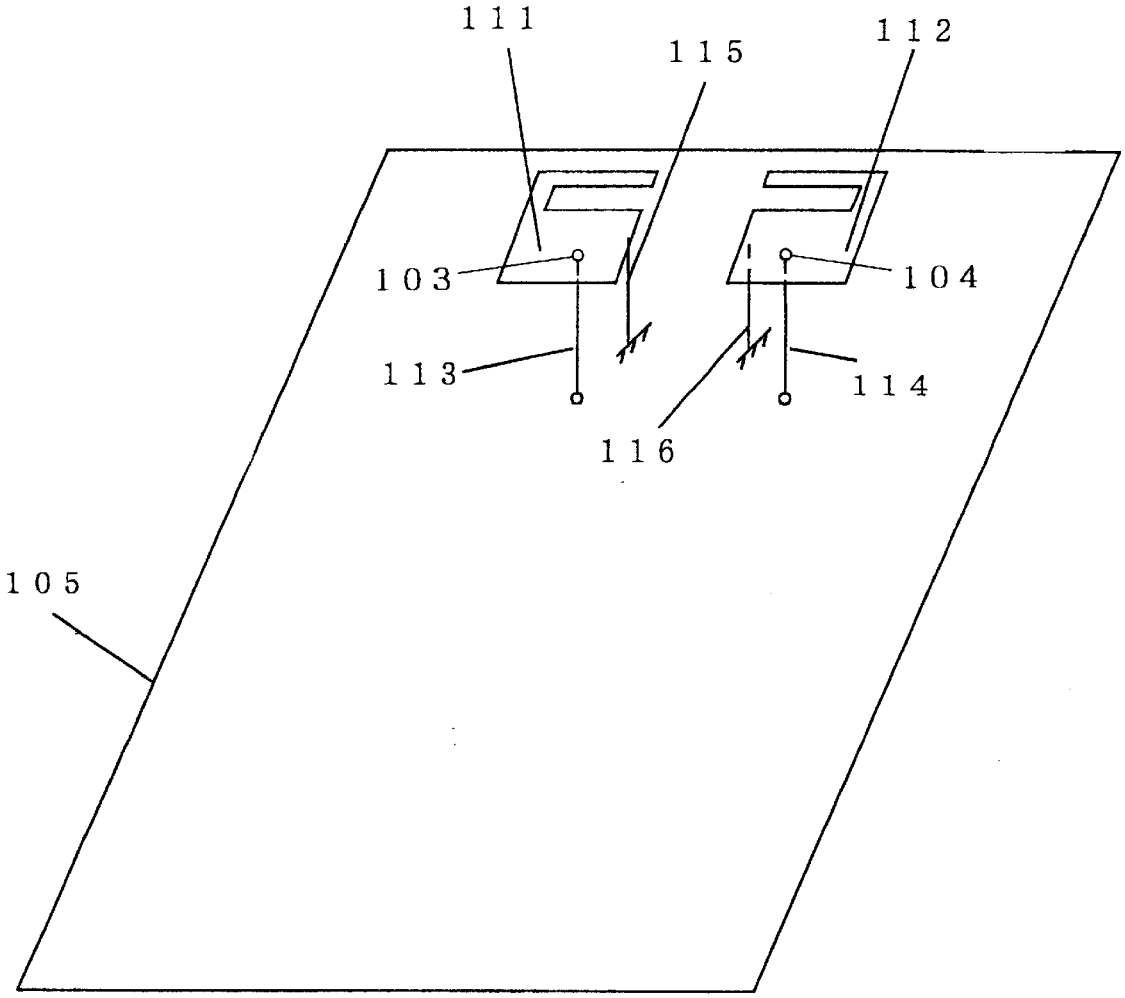
FIG. 5 is a concrete circuit diagram of the antenna for mobile wireless communications in a third embodiment of the present invention.

The abstract circuit diagram of the present embodiment is the same with FIG. 1. FIG. 5 shows a concrete circuit diagram of the antenna for mobile wireless communications in the third embodiment of the present invention. In FIG. 5, the same reference numerals are used for the same components with the first embodiment and, therefore, the description thereof is omitted.

The present embodiment is different from the first and the second embodiments in that the antenna elements 111, 112 are configured by having a slit in the metal plate of a polygon shape. The antennas of the present embodiment also resonate at the frequencies corresponding to the wavelengths substantially two times the ambient lengths. Accordingly, with the structure made in such manner as the present embodiment, a miniaturization can be effected even if the antennas resonating with the same frequencies are realized.

Figure 6:
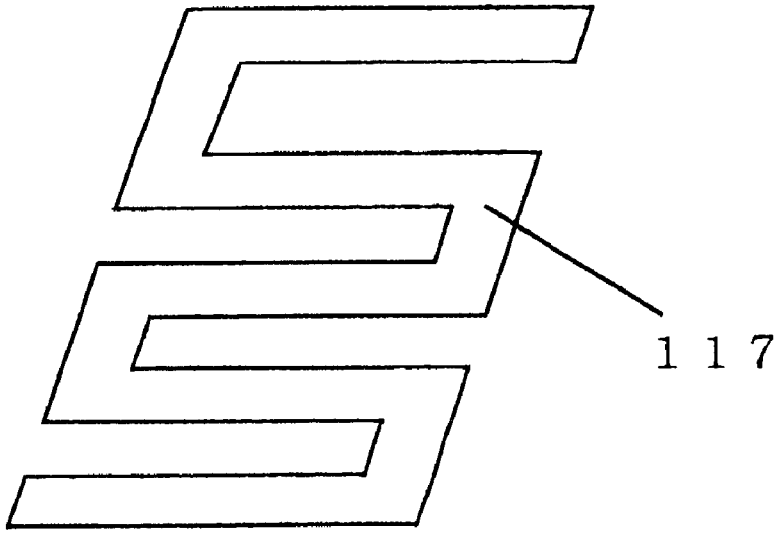
FIG. 6 is a drawing showing one example of the antenna elements of the antenna for mobile wireless communications in the third embodiment of the present invention.

Further, in the present embodiment, the slit is disposed at one place. However, as shown in FIG. 6, even if the antenna element 117 disposing the slits at a plurality of places is used, the same effect can be obtained.

Also, in the present embodiment, the two antennas 101 and 102 are arranged on the conductive ground plate 105. However, similar to the first and the second embodiment, the configuration in which they are not arranged on the conductive ground plate can be also-configured.

By being configured in such manner, the configuration in which the conductive ground plate required in the past is removed can be realized so that the antennas can be designed to be more compact in size and light in weight.

Also, in the present embodiment, the antennas 101 and 102 are axi-symmetrically arranged. However, without being arranged in such manner, balanced operations are performed so that the same effect can be obtained.

Also, in the present embodiment, since the resonance frequency can be changed by changing the physical relationship between the feeding point and the ground plate metal wire and also since the broad band can be realized by using a plurality of ground metal wires for grounding, the same effect with the first and the second embodiments can be obtained.

Also, even by making the ambient lengths of the two antenna elements different lengths, the broad band can be realized so that the same effect with the second embodiment can be obtained.

Also, in the present embodiment, the metal plates in the shape of a polygon having a slit inserted therein is used for the antenna elements 111 and 112. However, even if the metal plates in the shape of a circle having a slit inserted therein is used, the same effect can be obtained.

Moreover, in the present embodiment, similar to the first and the second embodiments, by narrowing the intervals between the two antennas, the broad band for the antennas can be realized

Fourth Embodiment

Next, an antenna for mobile wireless communications in a fourth embodiment of the present invention will be described with the accompanied drawings.

Figure 7:
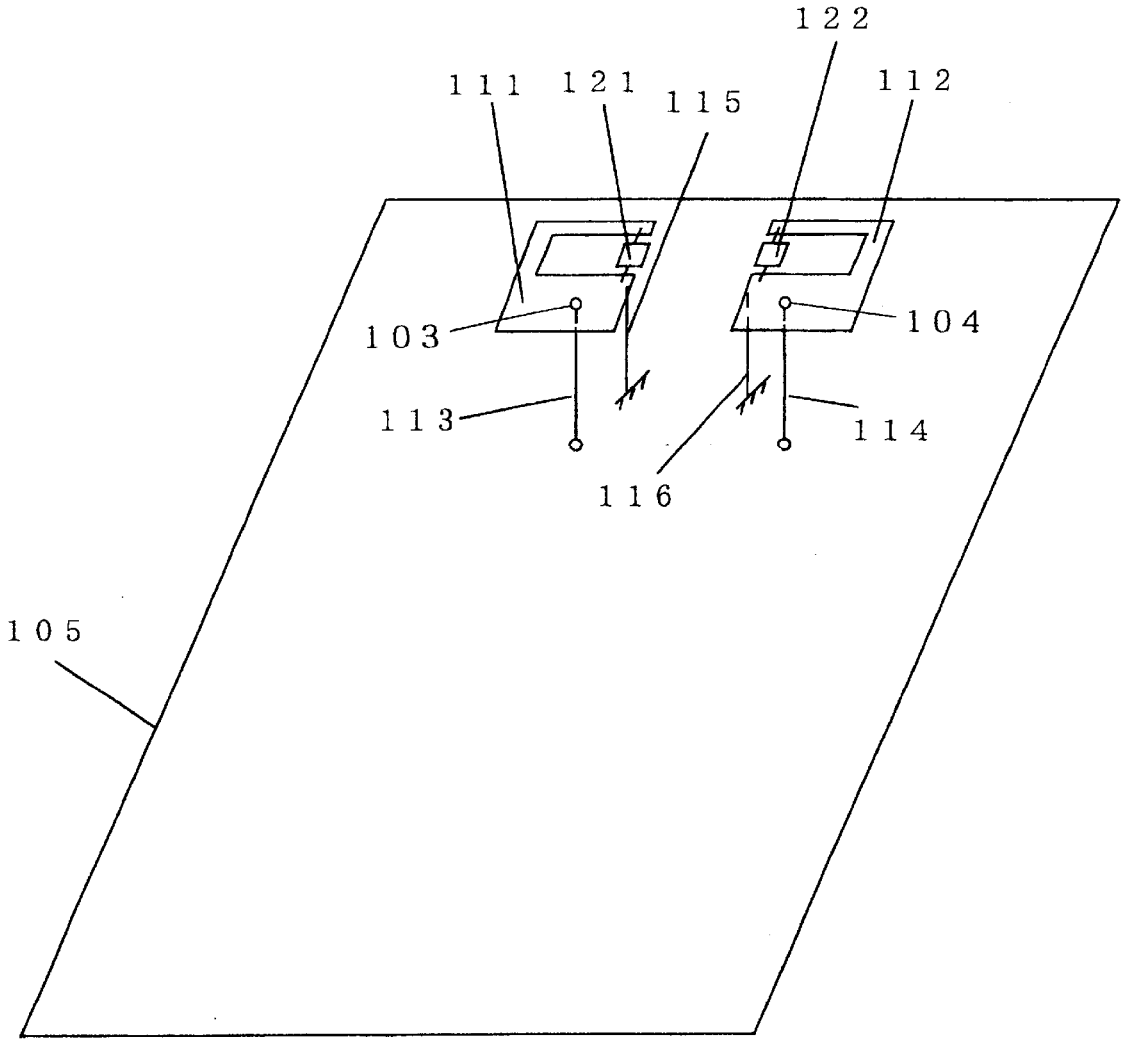
FIG. 7 is a concrete circuit diagram of the antenna for mobile wireless communications in a fourth embodiment of the present invention.

The abstract circuit diagram of the present embodiment is the same with FIG. 1. FIG. 7 is a concrete circuit diagram of the antenna for mobile wireless communications in the fourth embodiment of the present invention.

In FIG. 7, the same reference numerals are used for the same components with the third embodiment and, therefore, the description thereof is omitted. 121, 122 are switching circuits. For the switching circuits, for example, diodes are used.

The present embodiment is configured in such manner that the switching circuit is inserted into part of the slit portion of the antenna elements 111, 112. The operating principles at this time will be described with reference to FIG. 8.

FIG. 8A, FIG. 8B are typical diagrams magnifying the antenna elements in the present embodiment.

When the switching circuit is off (FIG. 8A), the antenna element resonates with the frequency corresponding to the wavelength substantially two times the ambient length d1 of the antenna elements 111, 112. The resonance frequency at this time is represented by f1.

On the other hand, when the switching circuit is on (FIG. 8B), since the ambient length looks as if it short-cuts the slit portion due to the switch inserted therein, the element resonates with the frequency corresponding to the wavelength substantially two times the ambient length d2. If the resonance frequency at this time is represented by f2, f2 becomes higher than f1 (FIG. 8C).

By being configured in such manner, the resonance frequency f1 when the switching circuit is off and the resonance frequency f2 when it is on can be changed. And by controlling the length of the slit and its number, the manner in which the resonance frequencies are changed can be set at random.

As a result, the broad band for the antennas can be realized (FIG. 8C).

In the present embodiment, the slit is disposed at one place. However, even if there is disposed a plurality of slits, the same effect can be obtained. At this time, even if the switching circuits are disposed at a plurality of places, the same effect can be obtained.

Also, in the present embodiment, the switching circuits are configured by diodes. However, even if the switching circuits are configured by, for example, other elements such as transistors and the like, the same effect can be obtained.

Also, in the present embodiment, the two antennas 101, 102 are arranged on the conductive ground plate 105. However, similar to the first, the second and the third embodiments, the configuration can be made in such manner also that the antennas are not arranged on the conductive ground plate.

By being configured in such manner, the configuration in which the conductive ground plate required in the past is removed can be realized so that the antennas can be designed to be more compact in size and light in weight.

Also, in the present embodiment, the antennas 101, 102 are arranged axi-symmetrically. However, without being arranged in such manner, balanced operations are performed so that the same effect can be obtained.

Also, in the present embodiment, the metal plates in the shape of a polygon having a slit inserted therein are used for the antenna elements 111 and 112. However, even if the metal plates in-the shape of a circle having a slit inserted therein are used, the same effect can be obtained.

Moreover, in the present embodiment, similar to the first, the second and the third embodiments, by narrowing the intervals between the two antennas, the broad band for the antennas can be realized.

Also, in the present embodiment, since the resonance frequency can be changed by changing the physical relationship between the feeding point and the ground plate metal wire and also since the broad band can be realized by using a plurality of ground metal wires for grounding, the same effect with the first, the second and the third embodiments can be obtained.

Also, even by making the ambient lengths of the two antenna elements different lengths, the broad band can be realized so that the same effect with the second embodiment can be obtained.

Fifth Embodiment

Next, an antenna for mobile wireless communications in a fifth embodiment of the present invention will be described with reference to the accompanied drawings.

The abstract circuit diagram of the antenna for mobile wireless communications of the present embodiment is the same with FIG. 1, and since the concrete circuit diagram is the same with FIG. 7, it is omitted.

Figure 9:
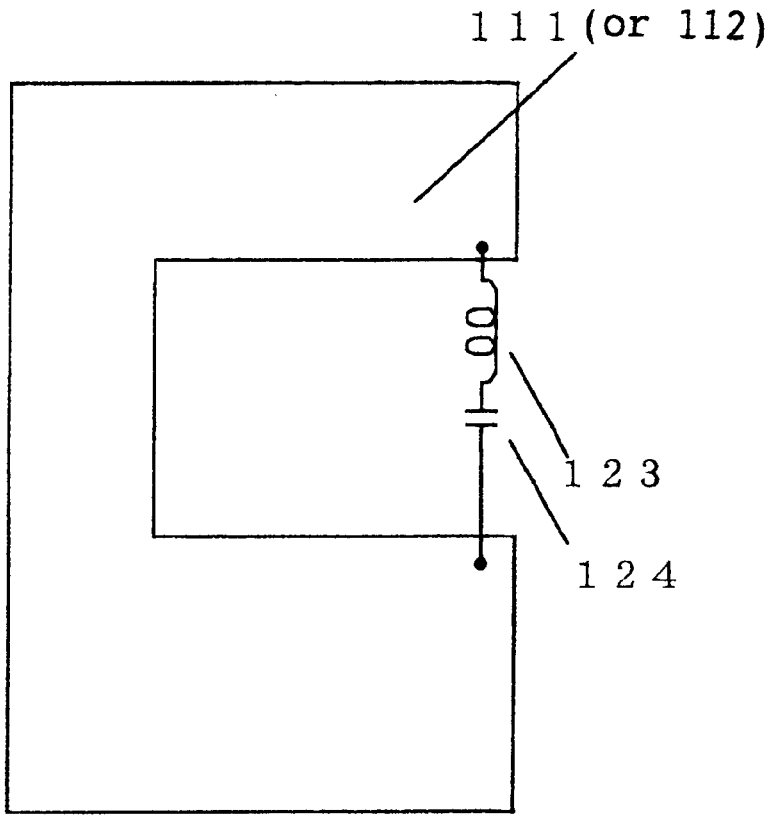
FIG. 9 is a magnified drawing of the antenna element of the antenna for mobile wireless communications in the fifth embodiment of the present invention.

FIG. 9 is a drawing magnifying an antenna element portion in the present embodiment. 123 is a coil and 124 is a capacitor. The coil 123 and the capacitor 124 are connected in series and form a serial resonance circuit. The difference from the fourth embodiment is that the serial resonance circuit configured by the coil 123 and the capacitor 124 is used in a switching circuit.

The operating principles at this time will be described with reference to FIG. 10.

Figure 10A:
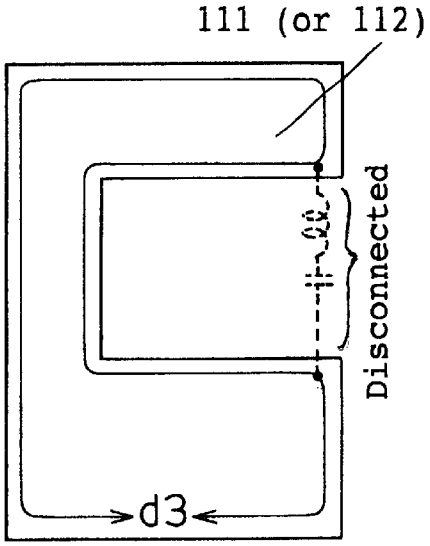
FIG. 10A is a typical diagram describing operating principles at the frequency f3 of the antenna for mobile wireless communications in a fifth embodiment of the present invention.
Figure 10B:
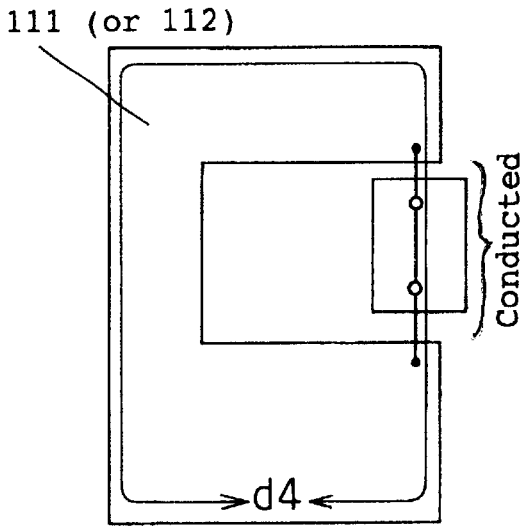
FIG. 10B is a typical diagram describing operating principles at a frequency f4 of the antenna for mobile wireless communications in the fifth embodiment.
Figure 10C:
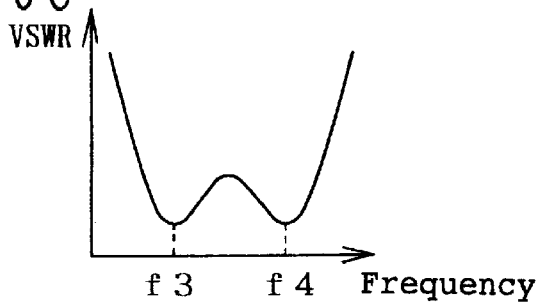
FIG. 10C is an explanatory drawing of the realization of the broad band for the antenna for mobile wireless communications in the fifth embodiment.

As shown in FIG. 10A to FIG. 10C, the frequency corresponding to the wavelength which is substantially two times the ambient length d3 of the antenna element is represented by f3, the frequency corresponding to the wavelength which is substantially two times of the length d4 by f4 and the resonance frequency of the serial resonance circuit(refer to FIG. 9) by f4. In case of the frequency f3, an impedance of the serial resonance circuit is extremely large and the circuit is almost electrically off. For this reason, the antenna resonates with the f3 (refer to FIG. 10A).

On the other hand, in case of f4, the impedance of the serial resonance circuit is close to 0Ω and the circuit is electrically on. For this reason, since the ambient length of the antenna element looks like d4, the antenna resonates even with the frequency f4 (FIG. 10B).

Thus, with the structure made in such manner as the present embodiment, multi-resonance antennas can be realized without switching-operations so that the broad band can be realized (FIG. 10C).

Moreover, in the present embodiment, the serial resonance circuit is configured by the coil and the capacitor. However, even if it is configured by other circuit such as a distributed constant line and the like, the same effect can be obtained.

Also, in the present embodiment, the slit is disposed at one place. However, even if there is disposed a plurality of slits, the same effect can be obtained. At this time, even if the switching circuits are disposed at a plurality of places, the same effect can be obtained.

Also, in the present embodiment, the two antennas 101, 102 are arranged on the conductive ground plate 105. However, similar to the first, the second, the third and the fourth embodiments, the configuration can be made in such manner also that the antennas are not arranged on the conductive ground plate.

By being configured in such manner, the configuration in which the conductive ground plate required in the past is removed can be realized so that the antennas can be designed to be more compact in size and light in weight.

Also, in the present embodiment, the antennas 101 and 102 are arranged axi-symmetric. However, without being arranged in such manner, balanced operations are performed so that the same effect can be obtained.

Also, in the present embodiment, the metal plates in the shape of a polygon having a slit inserted therein are used for the antenna elements 111 and 112. However, even if the metal plates in the shape of a circle having a slit inserted therein are used, the same effect can be obtained.

Moreover, in the present embodiment, similar to the first, the second, the third and the fourth embodiment, by narrowing the intervals between the two antennas, the broad band for the antennas can be realized.

Also, in the present embodiment, since the resonance frequency can be changed by changing the physical relationship between the feeding point and the ground plate metal wire and also since the broad band can be realized by using a plurality of ground metal wires for grounding, the same effect with the first, the second, the third and the fourth embodiments can be obtained.

Also, even by making the ambient.lengths of the two antenna elements different lengths, the broad band can be realized so that the same effect with the second embodiment can be obtained.

Sixth Embodiment

Next, an antenna for mobile wireless communications in a six embodiment of the present invention will be described with reference to the accompanied drawings.

The abstract circuit diagram of the antenna for mobile wireless communications of the present,embodiment is the same with FIG. 1, and since a concrete circuit diagram is the same with FIG. 7, it is omitted.

Figure 11:
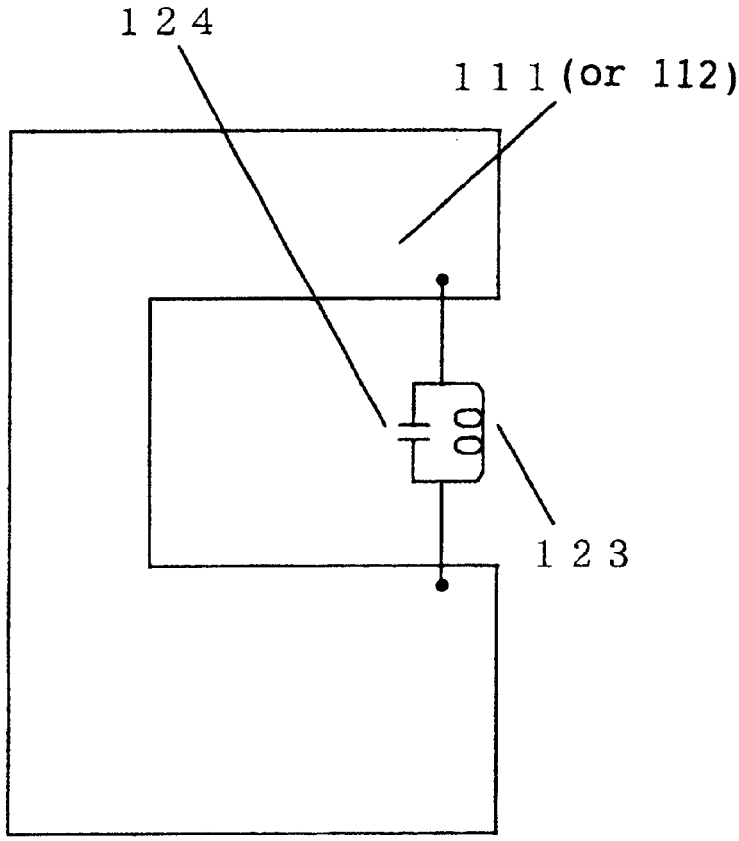
FIG. 11 is a magnified drawing of the antenna element of the antenna for mobile wireless communications in a sixth embodiment of the present invention.

FIG. 11 is a drawing magnifying an antenna element portion in the present embodiment. 123 is a coil and 124 is a capacitor. The coil 123 and the capacitor 124 are connected in series and form a serial resonance circuit.

The difference from the fifth embodiment is that the serial resonance circuit configured by the coil 123 and the capacitor 124 is used in a switching circuit.

The operating principles at this time will be described with reference to FIG. 12A to FIG. 12C.

Figure 12A:
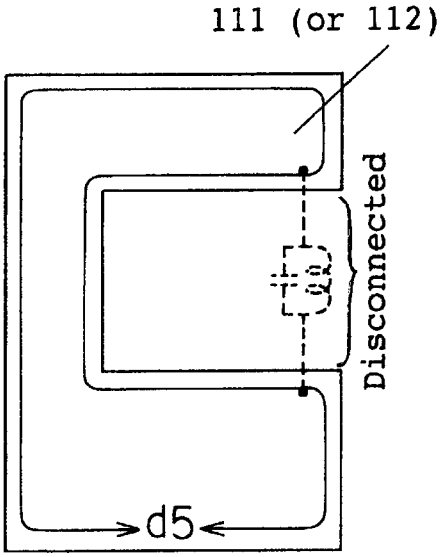
FIG. 12A is a type drawing describing operating principles at a frequency f5 of the antenna for mobile wireless communications in the sixth embodiment of the present invention.
Figure 12B:
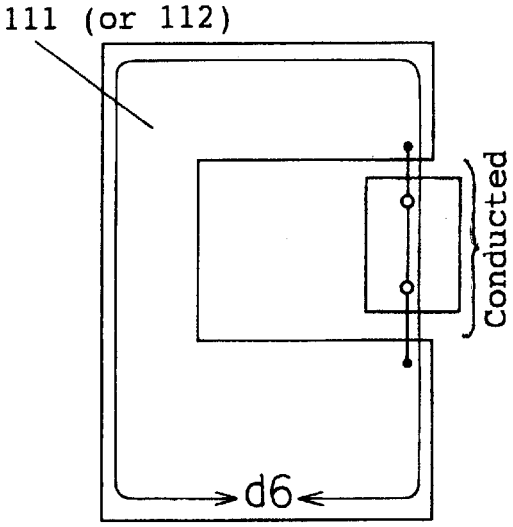
FIG. 12B is a type drawing describing operating principles at a frequency f6 of the antenna for mobile wireless communications in the sixth embodiment.
Figure 12C:
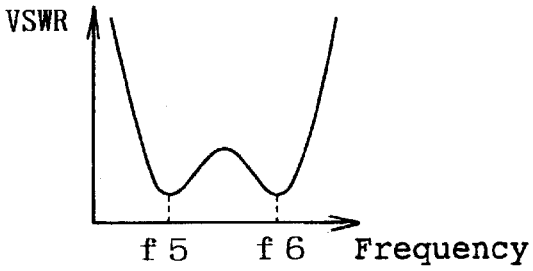
FIG. 12C is an explanatory drawing of realization of the broad band for the antenna in the sixth embodiment.

As shown in FIG. 12A to FIG. 12C, the frequency corresponding to the wavelength which is substantially two times the ambient length d5 of the antenna element is represented by f5, the frequency corresponding to the wavelength which is substantially two times of the length d6 by f6 and the resonance frequency of the serial resonance circuit (refer to FIG. 11) by f5. In case of the frequency f5, an impedance of the serial resonance circuit is extremely large and the circuit is almost electrically disconnected. For this reason, the antenna resonates with the f5.

On the other hand, in case of f6, by selecting an inductance value so as to sufficiently lower the impedance of the coil, the impedance of a parallel resonance circuit comes to 0Ω and the circuit-is electrically conducted. For this reason, the ambient length of the antenna element looks like d6 and the antenna resonates even with the frequency f6.

Thus, with the structure made in such manner as the present embodiment, similar to the case of the fifth embodiment, the multi-resonance antennas can be realized without performing the switching so that the broad band can be realized. In other respects too, the same effect with the fifth embodiment can be obtained.

Further, in the present embodiment, the parallel resonance circuit is configured by the coil and the capacitor. However, even if it is configured by other circuit such as a distributed constant line and the like, the same effect can be obtained.

Also, in the present embodiment, the metal plates in the shape of a polygon having a slit inserted therein is used for the antenna elements 111 and 112. However, even if the metal plates in the shape of a circle having a slit inserted therein are used, the same effect can be obtained.

Seventh Embodiment

Hereinafter, an antenna for mobile wireless communications in a seventh embodiment of the present invention will be described with reference to the accompanied drawings. The drawing in which a circuit diagram is abstractly shown is the same with FIG. 7.

Figure 13:
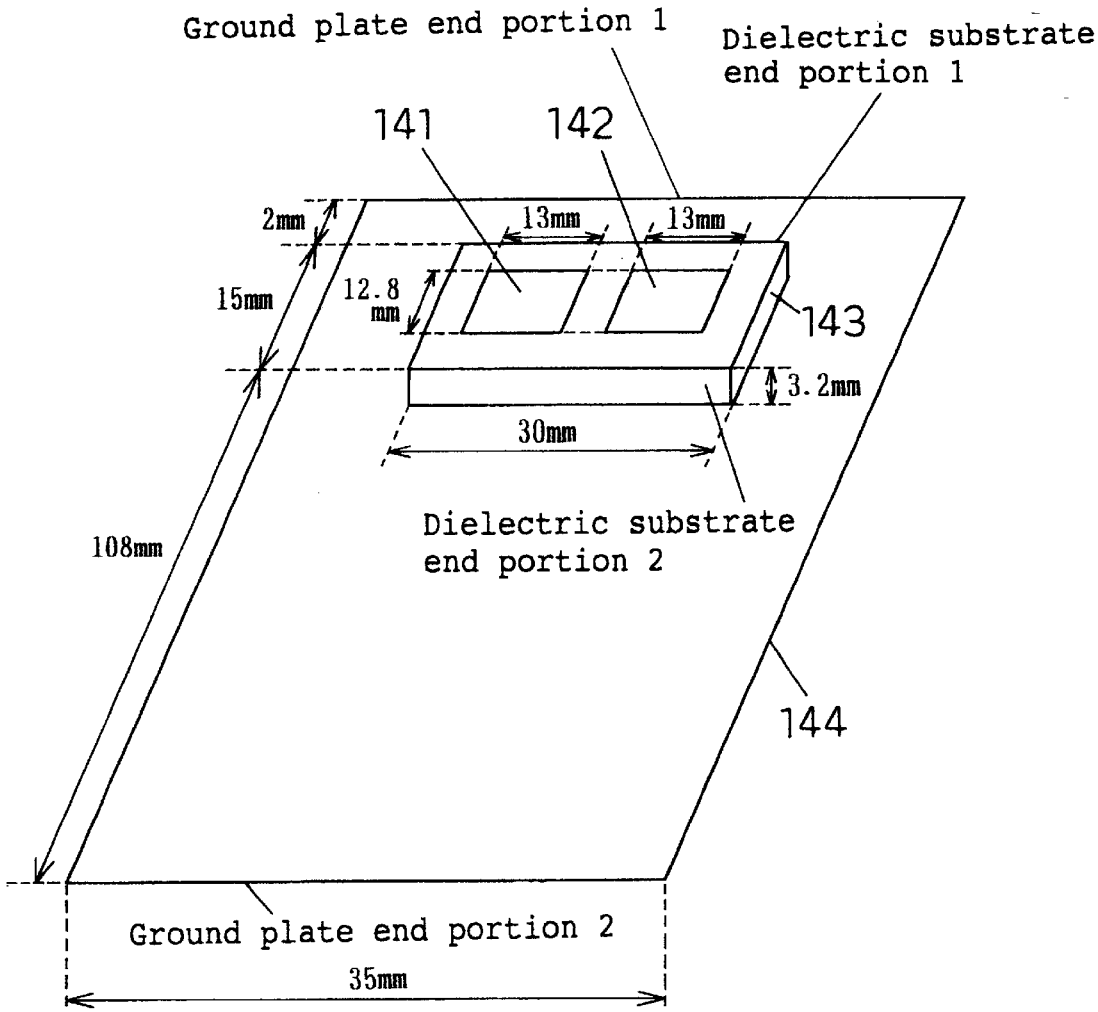
FIG. 13 is a drawing showing a antenna configuration of the antenna for mobile wireless communications in a seventh embodiment of the present invention.

FIG. 13 shows a structure of the antenna for mobile wireless communications in the seventh embodiment of the present invention.

Antenna elements 141, 142 in the shape of a rectangle are formed on a dielectric substrate 143 and the dielectric substrate 143 is formed on a ground.plate 144. For example, a dielectric of dielectric constant 3.6 is used for the dielectric substrate 143. The dimension thereof is 30 mm in length, 15 mm in shortest side and 3.2 mm in thickness and the dimension of the antenna elements formed thereon is 13 mm×12.8. Also, the ground plate 144 is a metal plate of 125 mm in length and 35 mm in width.

The physical relationship between the dielectric substrate 143 and the ground plate 144 is such that an end portion 1 of the dielectric substrate is arranged so as to be at the place shifted 2 mm longitudinally from an end portion 1 of the ground plate 144 as shown in FIG. 13. That is, the dielectric substrate 143 is arranged at the place shifted from the center against the length of the ground plate 144. The distance from an end portion 2 of the dielectric substrate 143 to an end portion 2 of the ground plate is 108 mm.

On the other hand, the two elements are arranged approximately at the center against the shortest side.

Figure 14:
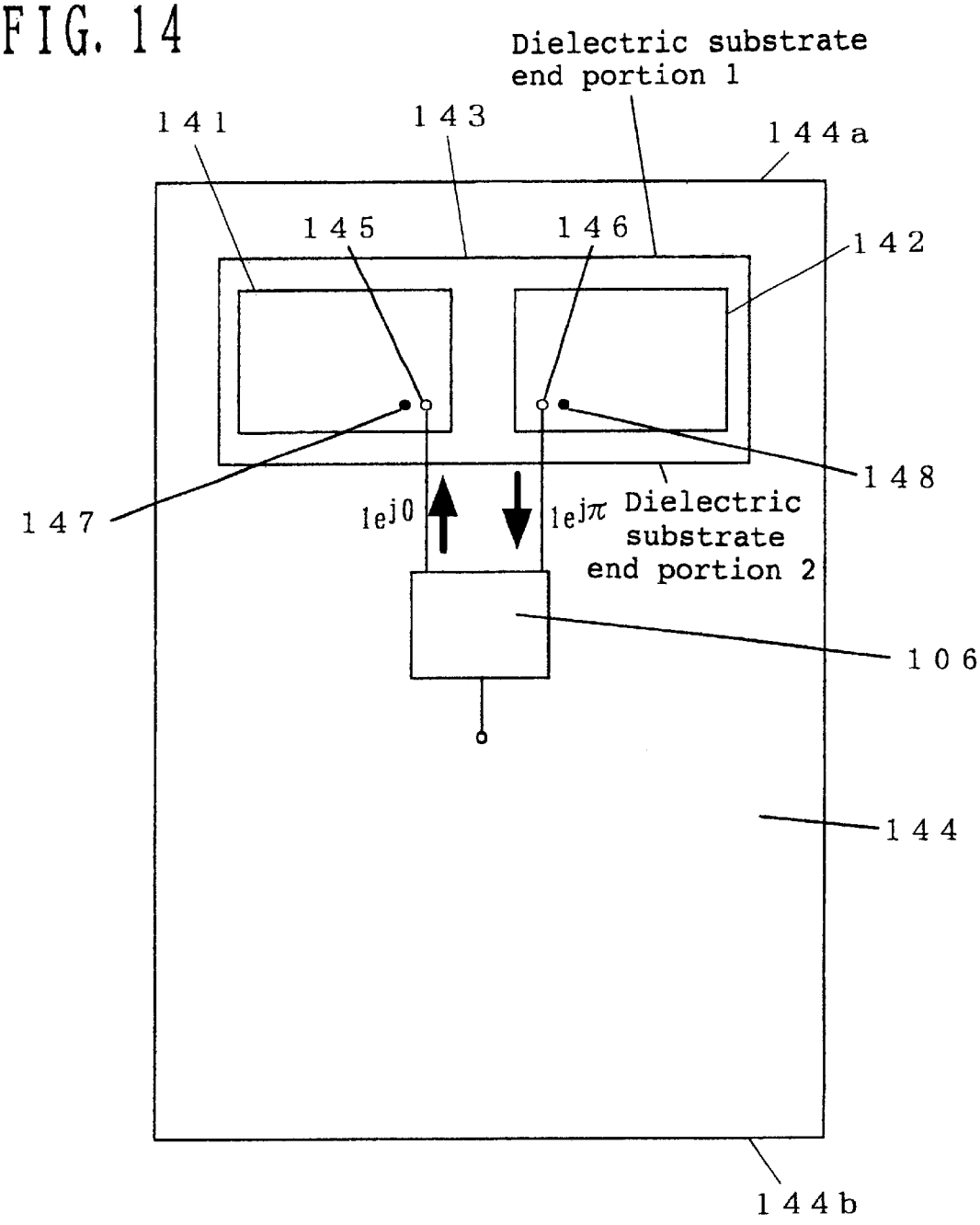
FIG. 14 is a top view of the antenna for mobile wireless communication in the seventh embodiment of the present invention.

Next, a top view of FIG: 13 is shown in FIG. 14. 145, 146 are feeding points and 147, 148 are through-holes. The antenna elements 141, 142 are grounded to the ground plate 144 by the through-holes.

In order to take an impedance matching of the antennas, the feeding points 145, 146 are arranged in close vicinity to the through-holes 147, 148.

Also, the feeding points 145, 146 are disposed close to the lower side in the drawing of the antenna elements 141, 142, that is, close to the dielectric substrate end portion 2 and in the location (close to the center portion of the dielectric substrate 143 in the drawing) of the side opposing to other antenna elements. While, in the present embodiment, described therein is the case where the antenna elements are arranged in the location close to the upper end portion in the drawing of the ground plate 144. On the contrary, however, if the antenna elements are arranged in the location close to the lower end portion of the ground plate, the above described feeding points will be arranged in the location close to the dielectric substrate end portion 1.

That is, if the distance between the dielectric substrate end portion 1 and the end portion 144*a* of the ground plate 144 is compared to the distance between the dielectric substrate end portion 2 and the end portion 144*b* of the ground plate 144, the location closer to the dielectric end portion of the long distance rather than the short distance will be chosen.

Thus, comparing to the case where both of the feeding point 145 (146) and the through-hole 147 (148) are arranged in the center portion of the antenna element 141 (142) or both these points are arranged isolated at both ends of the antenna element, this case will demonstrate the effect that radiation characteristics of the antennas are much enhanced.

As for a feeding method, similar to the above described embodiment, the balanced feeding is performed where the phase difference between the feeding points 145 and 146 is set at substantially 180 degrees. As a means for realizing such feeding for example, the balanced-to-unbalanced conversion circuit 106 such as a U-type balun circuit and the like is used.

Figure 15A:
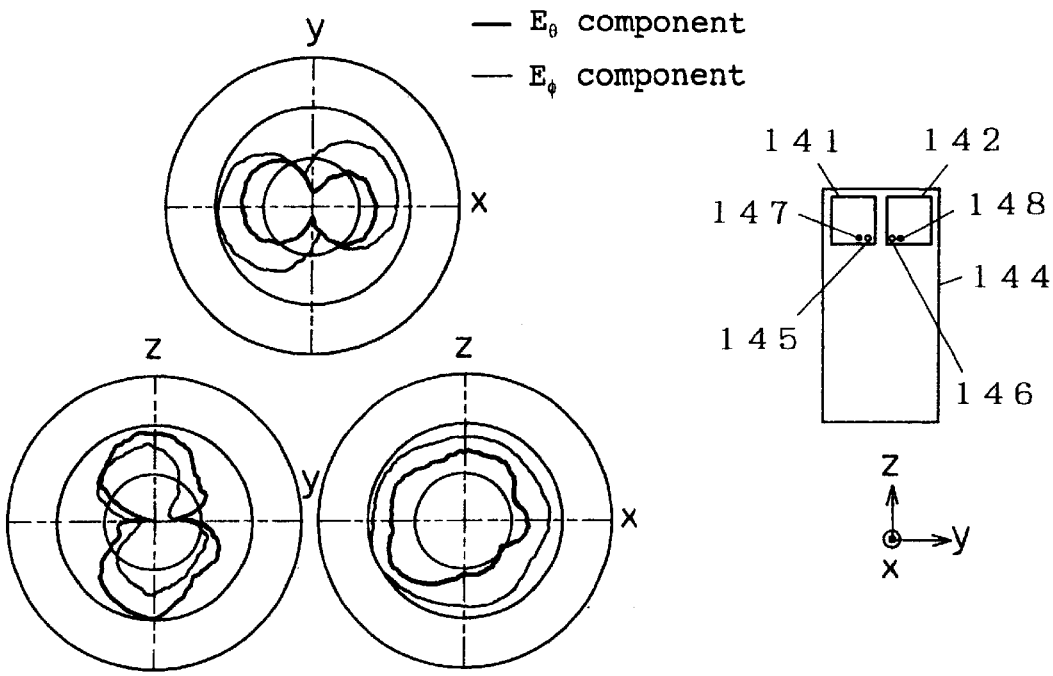
FIG. 15A is a drawing showing radiation characteristics of the antenna for mobile wireless communications in the seventh embodiment of the present invention.

The radiation characteristics of the antennas of the present embodiment are shown in FIG. 15A.

Figure 15B:
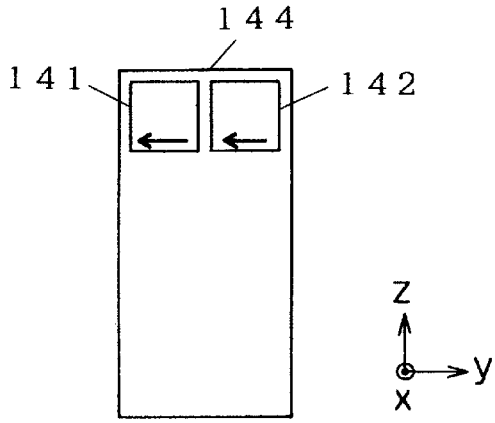
FIG. 15B is a drawing typically showing the current distribution of the antenna for mobile wireless communications in the seventh embodiment of the present invention.
Figure 22:
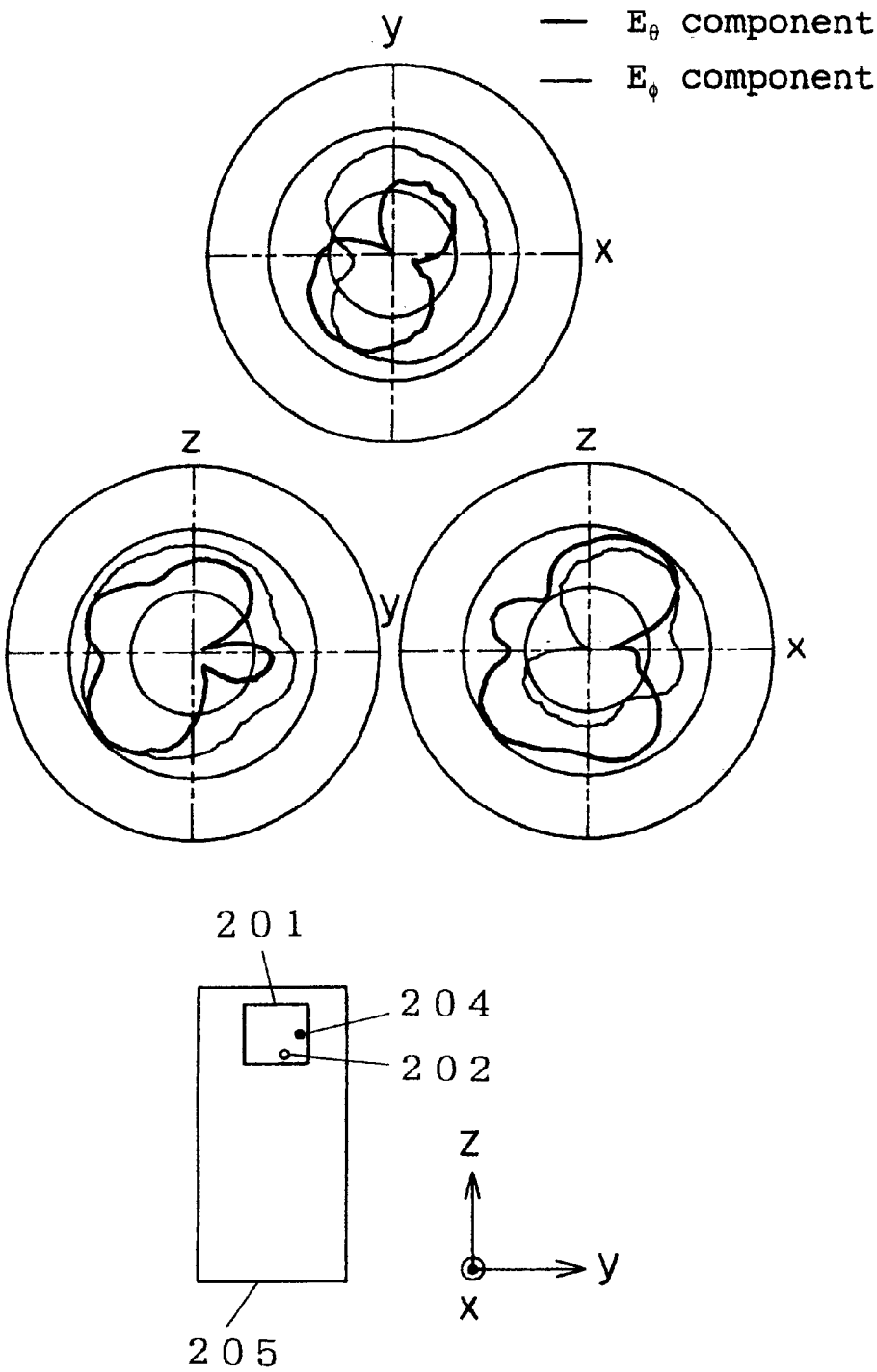
FIG. 22 PRIOR ART
FIG. 22 is a drawing showing radiation characteristics of the conventional antenna for mobile wireless communications.
Figure 23:
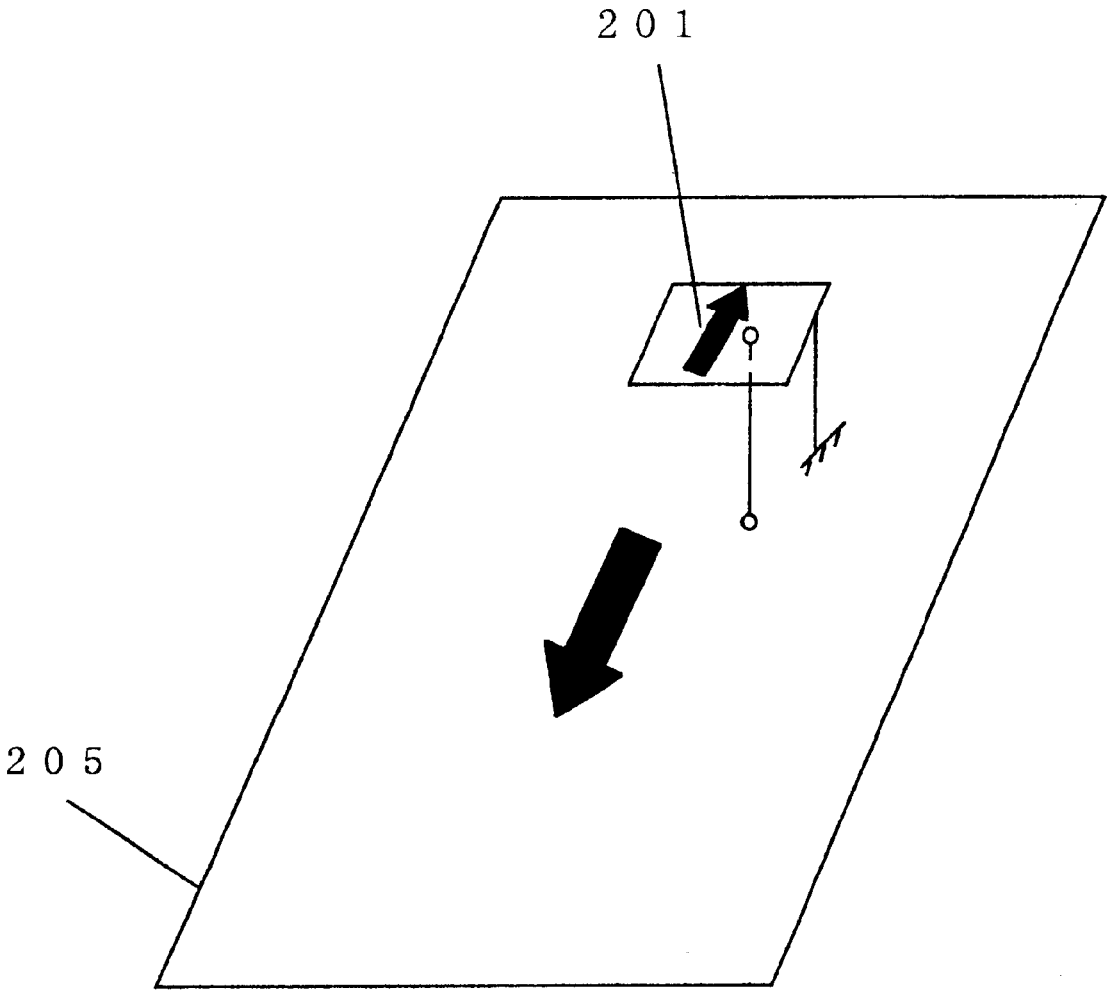
FIG. 23 PRIOR ART
FIG. 23 is a drawing showing schematically a current distribution of the conventional antenna for mobile wireless communications.

It will be understood that the antennas of the present embodiment are different from FIG. 22 which shows radiation characteristics of the unbalanced type antenna of the prior art, but they are given characteristics similar to the radiation characteristics generated by the current distribution of the dipole antenna as shown in FIG. 15B.

From this, it will be understood that, in the antennas of the present embodiment, almost all current flows into the antenna elements and the current flowing into the ground plate is small.

Figure 16A:
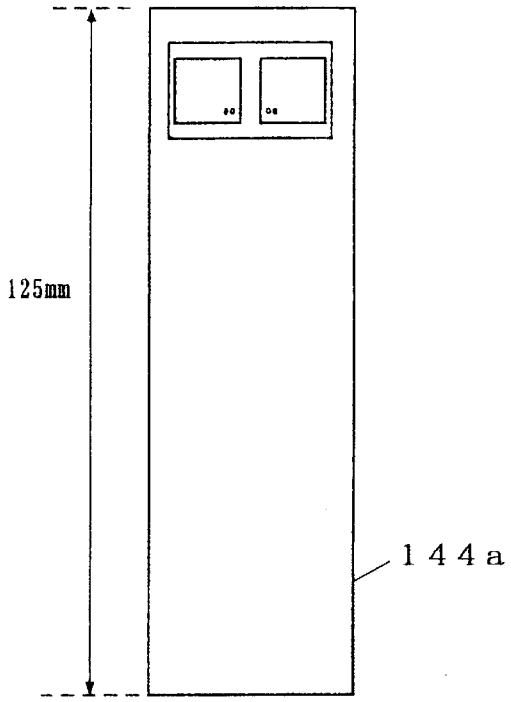
FIG. 16A is a drawing showing the antenna for mobile wireless communications with a ground plate of 125 mm in length in the seventh embodiment of the present invention.
Figure 16C:
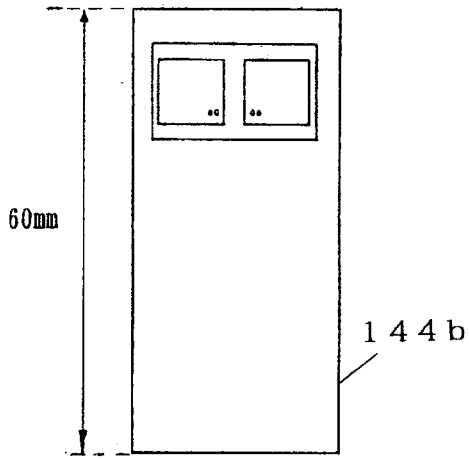
FIG. 16C is a drawing showing the antenna for mobile wireless communications with a ground plate of 60 mm in length in the seventh embodiment of the present invention.
Figure 16B:
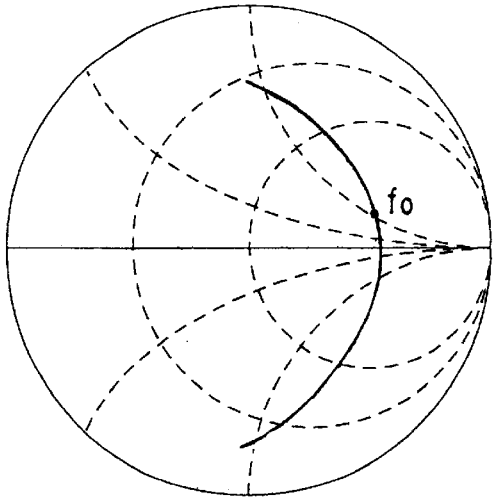
FIG. 16B is a drawing showing an impedance of the antenna for mobile wireless communications with the ground plate of 125 mm in length in the seventh embodiment of the present invention.
Figure 16D:
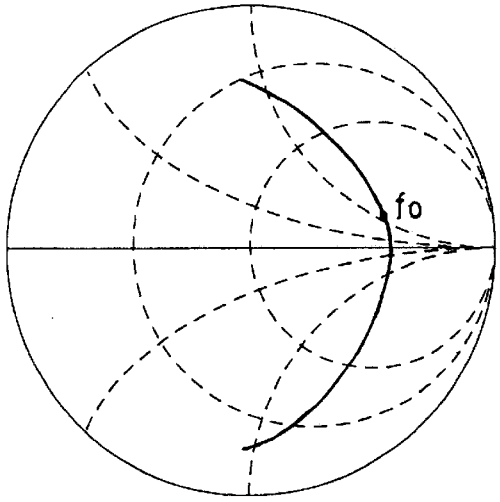
FIG. 16D is-a drawing showing the impedance of the antenna for mobile wireless communications with a ground plate of 60 mm in length in the seventh embodiment.

Next, a drawing of the antennas in which the length of the ground plate in the present embodiment is changed and a drawing of impedance characteristics corresponding to each change in the length are shown in FIG. 16A to FIG. 16D. That is, FIG. 16A is for the case where the length of the ground plate 144*a* is 125 mm and the characteristic diagram of this antenna is shown in FIG. 16B. Also, FIG. 16D is for the case where the length of the ground plate 144*b* is 60 mm and the characteristic diagram of this antenna is shown in FIG. 16D.

From this, it will be understood that the impedance of the antennas is hardly changed by the length of the ground plate. From this also, it will be understood that the current hardly flows into the ground plate.

Thus, with the structure made in such manner as the present embodiment, the current of the body of apparatus can be reduced by performing the balanced feeding from the end portion side opposite to the end portion of the side of the longitudinal ground plate where the antenna elements are disposed.

As a result, the deterioration of the radiation characteristics at the time when the human body holds the body of apparatus can be reduced. Moreover, in the present embodiment, the through-hole is disposed at one place. However, even if it is disposed at a plurality of places, the same effect can be obtained.

Also, in other than this respect, the same effect with the first embodiment can be obtained.

In each of the above described first to seventh embodiments, by performing balanced operations using two pieces of an unbalanced type antenna, the current flowing into the body of apparatus can be reduced.

As a result, the effect on the antenna characteristics at the time when the human body holds the body of apparatus can be reduced.

Eighth Embodiment

Next, an antenna for mobile wireless communications in an eighth embodiment of the present invention will be described with reference to the accompanied drawings. A drawing abstractly showing a circuit diagram is the same with FIG.

Figure 17:
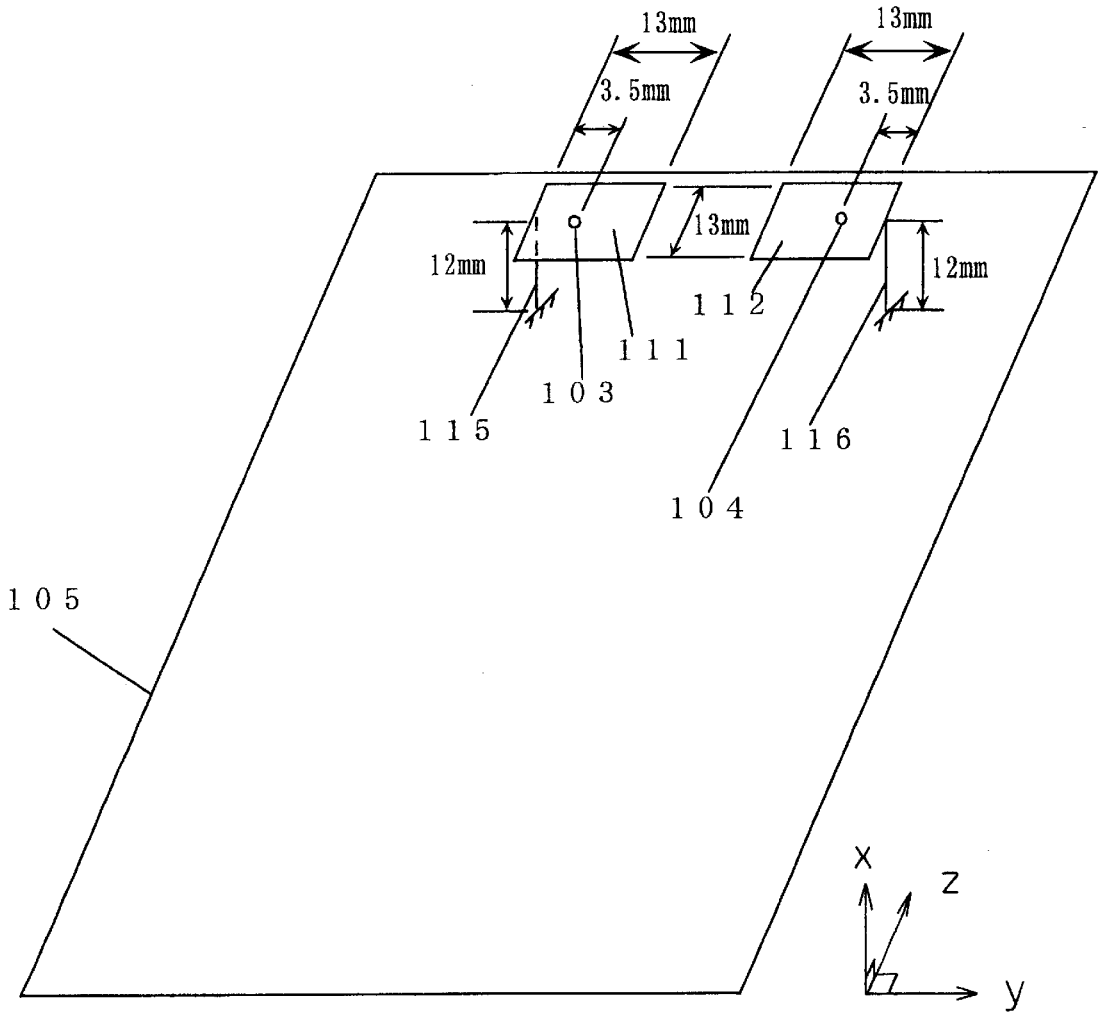
FIG. 17 is a drawing showing a concrete structure of the antenna for mobile wireless communications in an eighth embodiment of the present invention.

FIG. 17 shows an antenna structure of the antenna for mobile wireless communications in the eighth embodiment of the present invention. The basic configuration of the present embodiment is the same with the configuration of the first embodiment as described in FIG. 2. In FIG. 17, the same reference numerals are attached to the same components with FIG. 2.

In the present embodiment, the size of the antenna elements 111, 112, the locations of the feeding points 103, 104, the locations of the metal wires 115, 116 connected to the conductive ground plate 105 and the distance between the antenna elements and the conductive ground plate are as shown in FIG. 17. The metal wires 115, 116 are arranged outside each antenna element and the feeding points are arranged 3.5 mm inside from there.

In the present embodiment too, similar to the first embodiment, the balanced feeding is performed with the phase difference of substantially 180 degrees between the feeding points 103 and 104. As a result, similar to the case of the first embodiment, since a current hardly flows into the conductive ground plate 105 forming a body of apparatus, the deterioration of the radiation characteristics at the time when the human body holds the body of apparatus can be reduced.

Figure 18:
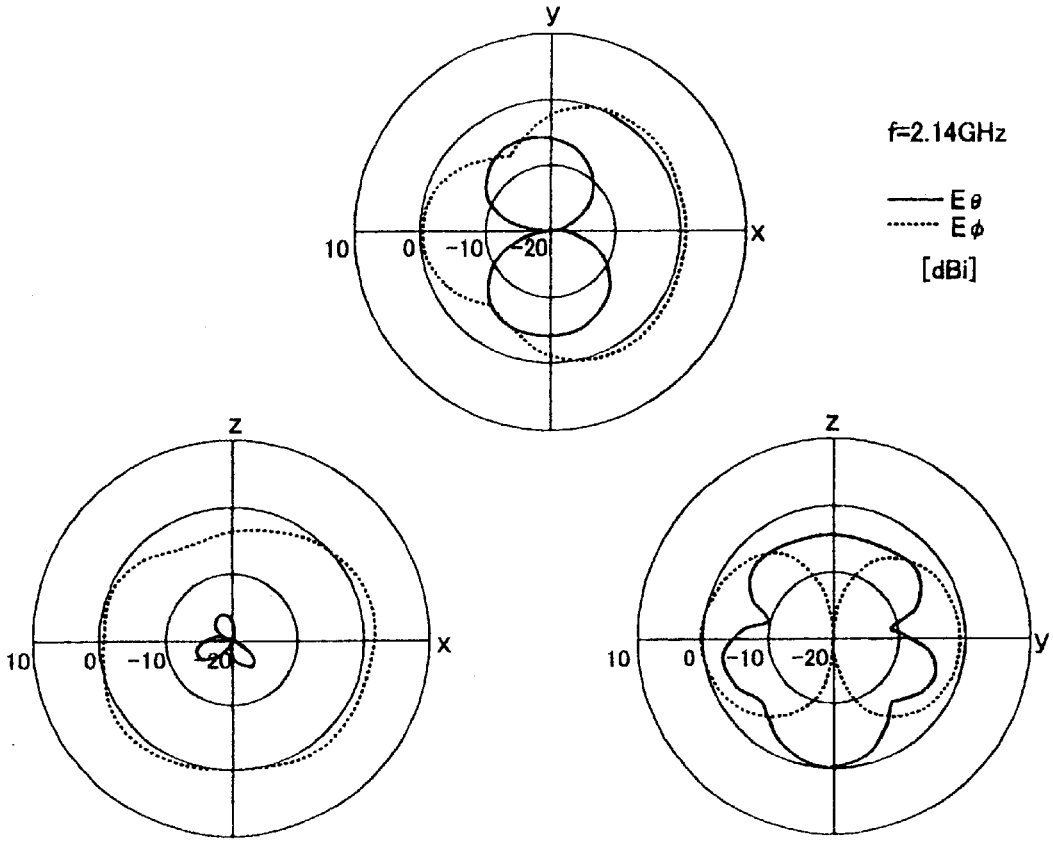
FIG. 18 is a drawing showing radiation characteristics of the antenna for mobile wireless communications in the eighth embodiment of the present invention.
Figure 18:
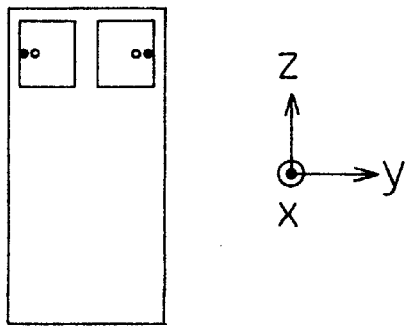

The radiation characteristics of the antennas of the present embodiment are shown in FIG. 18. The radiation characteristics show that the largest radiation is observed in+X direction by which a coordinates axis is defined as shown in FIG. 18. This is because the amount of current on the antenna elements is the largest when the locations of the metal wires short-circuited with the conductive ground plate are shifted to+Z direction. Usually when the human body holds this body of apparatus and assumes a posture of talking over the telephone, the+X direction is opposite to the head of the human body (refer to FIG. 20). That is, by enabling to emit strongly in the+X direction, the deterioration of the antenna characteristics by the human body can be decreased at the time when the human body assumes a posture of talking over the telephone.

Moreover, in the present embodiment, the antennas 101, 102 are configured by the antenna elements made of metal plates and the metal wires. However, they can be also configured by the antennas formed by the dielectric substrates or by chip antennas formed by laminating dielectrics. By using the dielectrics, further miniaturization can be realized.

Moreover, in the present embodiment, the conductive ground late 105 is configured by the metal plate such as a copper plate and the like. However, even if it is configured by the dielectric substrate having a ground layer, the same effect can be obtained.

Ninth Embodiment

Next, an antenna for mobile wireless communications in a ninth embodiment of the present invention will be described with reference to the accompanied drawings. The drawing abstractly showing a circuit diagram is the same with FIG.

Figure 19:
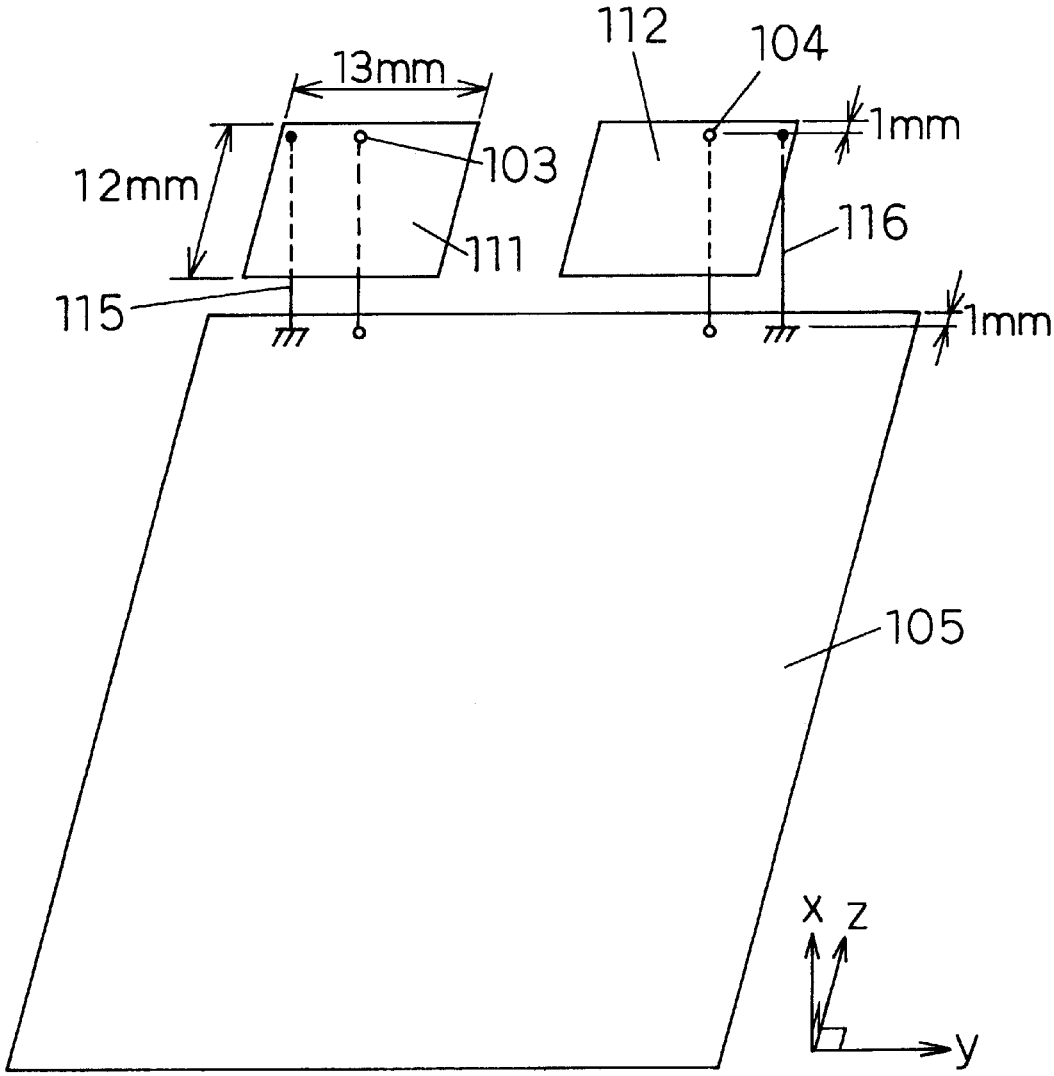
FIG. 19 is a drawing showing a concrete structure of the antenna for mobile wireless communications in a ninth embodiment of the present invention.

FIG. 19 shows a configuration of the antenna for mobile wireless communications in the ninth embodiment of the present invention. The basic configuration of the present embodiment is the same with the configuration of the first embodiment as described in FIG. 2. In FIG. 19, the same reference numerals are attached to the same components with FIG. 2.

In the present embodiment, the size of t he antenna elements 111, 112, the locations of the feeding points 103, 104, the locations of the metal wires 115, 116 connected to the conductive ground plate 105 and the distance between the antenna elements and the conductive ground plate are as shown in FIG. 19. Both of the antenna elements 111, 112 are arranged on the upper side portion (in close vicinity to the upper end portion of the conductive ground plate 105 in the drawing) of the conductive ground plate 105. At this time, both of the metal wires 115, 116 and the feeding points are arranged so as to be connected to each antenna element and the upper side portion of the conductive ground plate 105.

In the present embodiment too, similar to the first embodiment, the balanced feeding is performed with the phase difference of substantially 180 degrees between the feeding points 103 and 104. As a result, similar to the case of the first embodiment, since a current hardly flows into the conductive ground plate 105 forming a body of apparatus, the deterioration of radiation characteristics at the time when the human body holds the body of apparatus can be reduced. However, because the current extremely concentrates on feeders and short-circuit plates, except for the case where the locations of the two feeding points are identical, the current ultimately flows between the feeding points on the conductive ground plate. Similarly, the current ultimately flows between the short-circuit plates as well. For this reason, when the human body holds the body of apparatus, the more short the distance between fingers and the feeding points on the conductive ground plate and the short-circuit plate becomes, the more deteriorated the antenna characteristics become. Hence, by arranging the short-circuit plates and the feeding points on the upper side portion of each antenna element as shown in FIG. 19, the distance between the fingers and the short-circuit plates as well as the feeding points can become more distant so that the deterioration of the antenna characteristics by the human body can be reduced.

Moreover, in the present embodiment, the antennas 101, 102 are configured by the antenna elements made of metal and the metal wires. However, they can be configured also by the antennas formed by dielectric substrates or chip antennas configured by laminating dielectrics. By using dielectrics, further miniaturization can be effected.

Further, in the present embodiment, the conductive ground plate 105 is configured by the metal plate such as a copper or the like. However, even if it is configured by the dielectric substrate having a ground layer, the same effect can be obtained.

Furthermore, the arrangement of the feeders and the short-circuit plates is not limited to FIG. 19, but preferably to any location where the distance from the fingers becomes more distant at least when the human body holds the body of apparatus.

Tenth Embodiment

Next, a portable-type wireless apparatus in a tenth embodiment of the present invention will be described with reference to the accompanied drawings.

Figure 20:
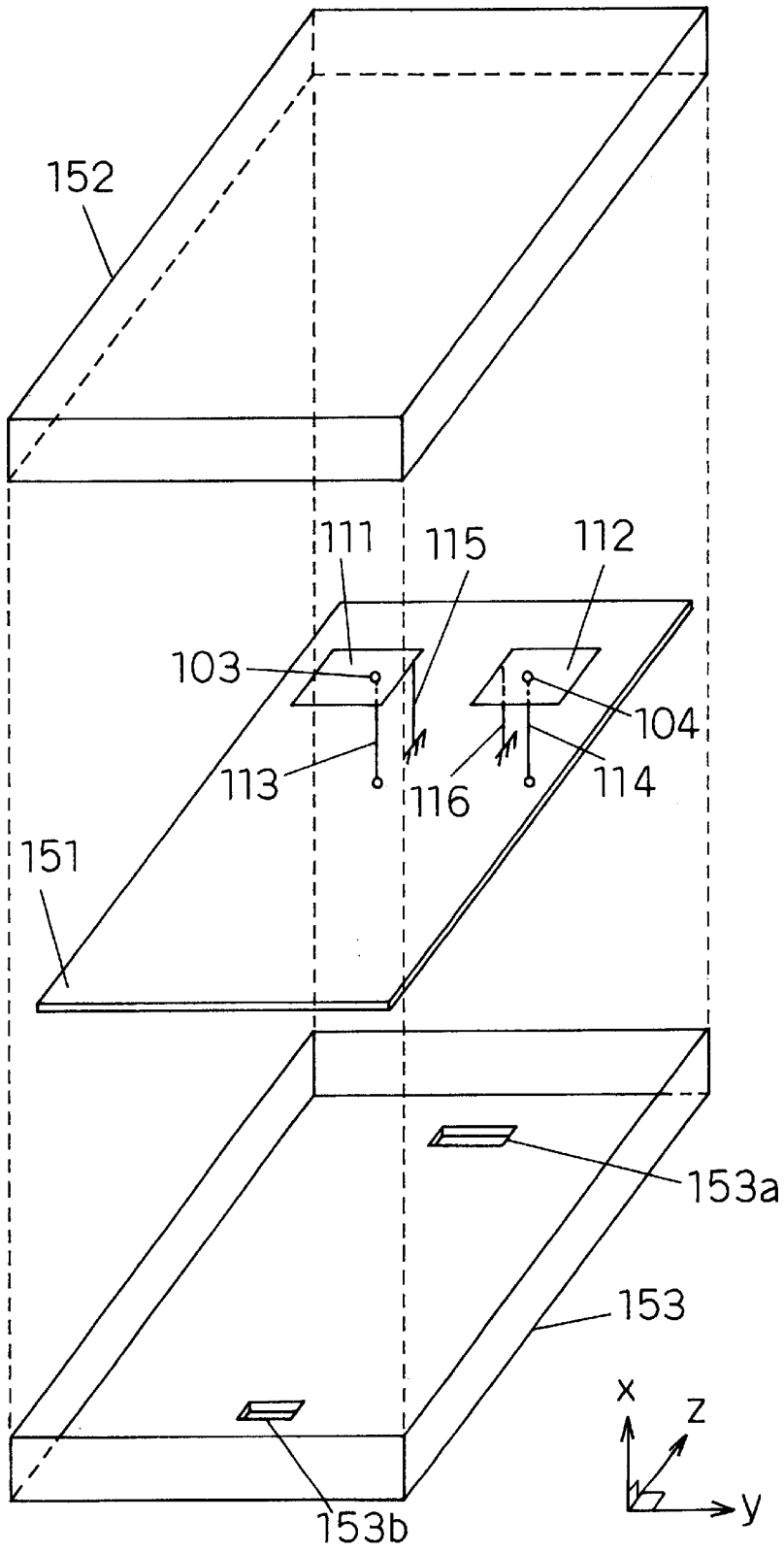
FIG. 20 is a exploded perspective view of a portable-type wireless apparatus in a tenth embodiment of the present invention.
Figure 21:
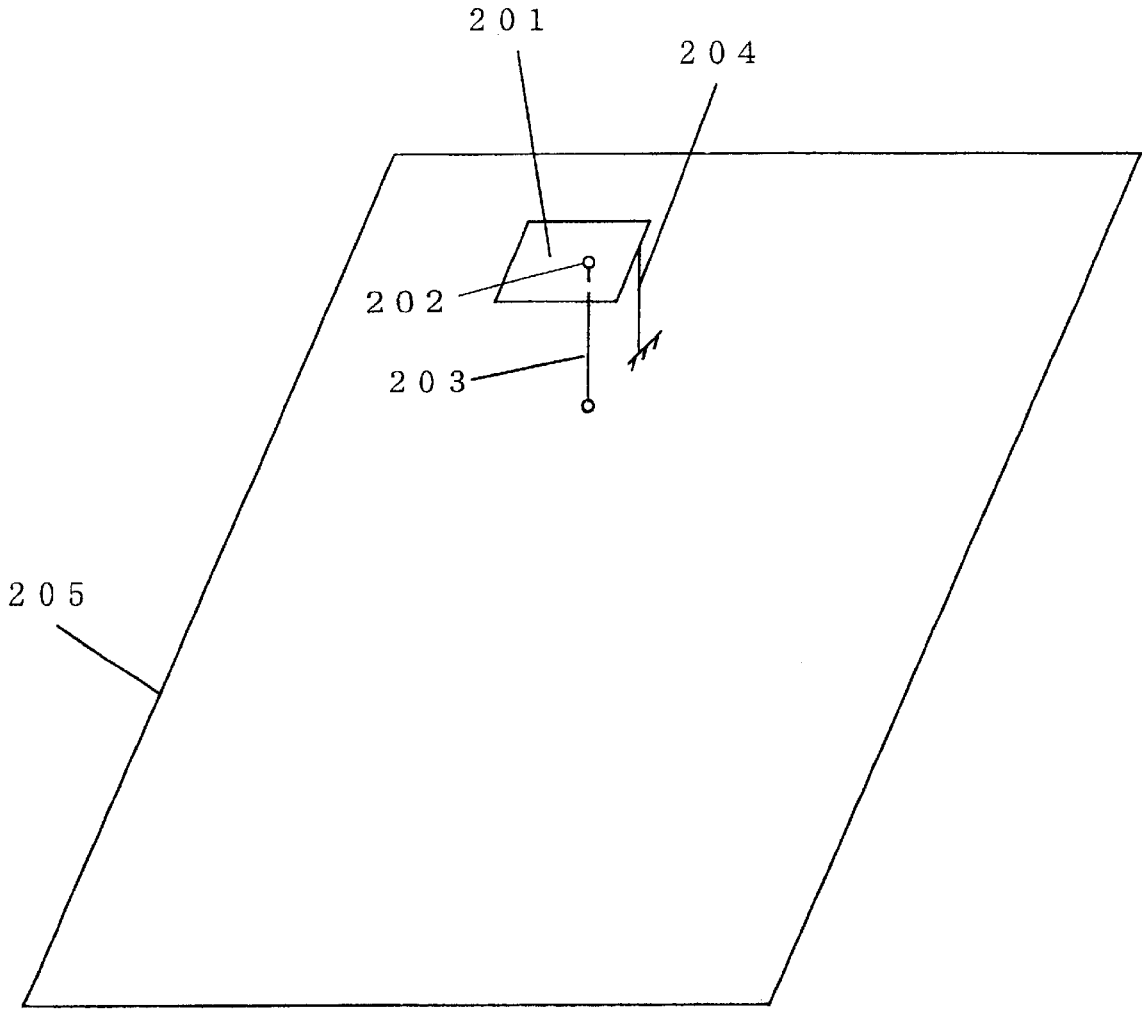
FIG. 21 PRIOR ART
FIG. 21 is a circuit diagram of a conventional antenna for mobile wireless communications.

FIG. 20 is an exploded perspective view of the portable-type wireless apparatus in the tenth embodiment of the present invention as seen from the back side.

The antennas used are the same with the first embodiment. In FIG. 20, the same reference numerals are attached to the same components with the first embodiment and, therefore, the description thereof is omitted.

In FIG. 20, 151 is a dielectric circuit substrate. 152 is a backside case made of resin which covers a backside of the dielectric circuit substrate 151, and 153 is a backside case made of resin which covers the backside of the dielectric circuit substrate 151. Also, on the backside case 153, an earpiece 153*a* in the shape of a slit is disposed in the place corresponding to the location of a speaker (not shown) arranged on the dielectric circuit substrate 151, and an earpiece 153*b* in the shape of a slit disposed in the place corresponding to the location of a microphone (not shown).

The dielectric circuit substrate 151 has a layer on the surface in which a various kind of circuit parts is mounted and a ground layer on the backside, and uses the ground layer as a ground plate of the antennas in the first embodiment.

That is, the metal wires 115, 116 are connected to the ground layer of the dielectric circuit substrate 151. Also, the surface of the dielectric circuit substrate 151 and the feeding point 103 existing on the antenna element 111 are connected via the metal wire 113. In the same manner, the surface of the dielectric circuit substrate 151 and the feeding point 104 existing on the antenna element 112 are connected via the metal wire 114.

The portable-type wireless apparatus has a shape in which the dielectric circuit substrate 151 and the antenna elements 111, 112 are covered with the cases made of resin 152, 153. Also, the cases 152, 153 are configured in such manner that, when assembled, they are integrally united.

In the present embodiment too, similar to the first embodiment, since a current hardly flows into the ground layer of the dielectric circuit substrate 151 which is the ground plate of the antennas, the characteristics of the antennas are not deteriorated even when the human body holds the portable-type wireless apparatus. That is, the antennas perform the same operations with the case of the first embodiment, thereby realizing the portable-type wireless apparatus in which the antenna characteristics are hardly affected by the human body.

Moreover, in the present embodiment, the dielectric circuit substrate is configured as the layer in which a various kind of circuit parts are mounted on the surface and the back side configured as the ground layer. However, even if they are configured otherwise, the same effect can be obtained. Also, even if a multi-layer substrate is used, the same effect can be obtained.

Further, in the present embodiment, the antennas are designated as those having the same structure with the first embodiment. However, the antennas of any one of the second to the seventh embodiment can be also used. In this case too, since the antennas perform the same operations with the case of each embodiment, the same effect with the case of each embodiment can be obtained. That is, the portable-type wireless apparatus in which the antenna characteristics are hardly affected by the human body can be realized.

Furthermore, the portable-type wireless apparatus is usually desirable to be in the size to the extent that it can be carried by a human being. In case of the portable-type wireless apparatus of the present embodiment, when operating with the frequencies above UHF band because of the relationship between the size and the length of the antennas to be used, the wireless apparatus can be configured by the size in which it is carried by the human being without any hindrance.

Still more, in the above described embodiment, the description is made for the case in which the antennas are disposed on the ground plate and electrically connected to the ground plate. However, for example, without being limited to this, the antennas may be electrically not connected to the ground plate. Or the ground plate itself may be not available. In addition, the antenna is not necessarily disposed directly on the ground plate, but may be disposed in the vicinity of the ground plate.

Also, in the above described embodiment, the description is made for the case where the difference of the feeding phase for the antennas is substantially 180 degrees. However, without being limited to this, the difference of the feeding phase may be in the range of approximately 180±30 degrees.

Also, in the above described embodiment, the description is made for the case where the structure of the elements is bisymmetric. However, without being limited to this, the shape of each element may be of a different structure.

Also, in the above described embodiments, the description is made for the case where the configuration of the antenna elements is substantially bisymmetric. However, without being limited to this, for example, the arrangement of both of the antenna elements may drift from the axisymmetric locations.

As it is clear from the above descriptions, the present invention can provide the antennas for mobile wireless apparatus in which the current of the body of apparatus is reduced and the effect of the human body is minimized and the portable-type wireless apparatus using the same.

What is claimed is:

1. An antenna for mobile wireless communications, comprising two antennas, each having a substantially (1) rectangular shape, (2) circular shape, or (3) polygonal shape having a single or a plurality of slits, wherein feeding phases for said two antennas are substantially different from each other, a ground plate bounded by a first perimeter and each antenna bounded by a second perimeter, wherein each antenna is arranged at a location above the ground plate to be substantially axi-symmetric to each other, and the second perimeter of each antenna is free-of contact with the first perimeter of the ground plate.

2. The antenna for mobile wireless communications according to claim 1, wherein the difference of the feeding phases between said two antennas is substantially 180 degrees.

3. The antenna for mobile wireless communications according to claim 1, wherein said two antennas are arrange in close vicinity to a ground plate.

4. The antenna for mobile wireless communications according to claim 3, wherein said two antennas are of the same shape, and moreover, the ambient lengths of the respective two antennas are either the same or different with each other.

5. The antenna for mobile wireless communications according to claim 4, wherein said two antennas are arranged in the location where they become substantially axi-symmetric.

6. The antenna for mobile wireless communications according to claim 5, comprising the feeding points connected to each antenna, wherein each of said two antennas is in the shape of a polygon or a circle and each of said two antennas is configured by the metal plates electrically short-circuited with said ground plate at least at one place.

7. The antenna for wireless communications according to claim wherein slits are disposed with said metal plates at least at one place.

8. The antenna for mobile wireless communications according to claim 6, wherein each said metal plate is of a rectangular shape and each portion in which each of said two metal plates arranged in a substantially axi-symmetric location is electrically short-circuited with said ground plate is inclose vicinity to the outer peripheral portion of said metal plate.

9. The antenna for mobile wireless communications according to claim wherein said portion is in close vicinity to a side opposite to each of respective sides where said metal plates arranged in said axi-symmetry stand face to face each other and, viewed from said portion, each said antenna is fed from the feeding point in close vicinity to a central portion of said metal plate.

10. The antenna for mobile wireless communications according to claim 3, comprising feeding points connected to each antenna, wherein each of said two antennas is in the shape of a polygon or a circle and each of said two antennas is configured by a metal plate electrically short-circuited with said ground plate at least at one place.

11. The antenna for mobile wireless communications according to claim 10, wherein each said metal plate is of a rectangular shape and each portion in which each of said two metal plates arranged in a substantially axi-symmetric location is electrically short-circuited with said ground plate is inclose vicinity to an outer peripheral portion of said metal plate.

12. The antenna for mobile wireless communications according to claim 11, wherein said portion is in close vicinity to a side opposite to each of respective sides where said metal plates arranged in said axi-symmetry stand face to face each other and, viewed from said portion, each said antenna is fed from the feeding point in close vicinity to a central portion of said metal plate.

13. An antenna for mobile wireless communications comprising two antennas, each having a substantially (1) rectangular shape, (2) circular shape, or (3) polygonal shape having a single or a plurality of slits, wherein feeding phases for said two antennas are substantially different from each other; wherein said two antennas are arranged in close vicinity to a ground plate, are of the same shape, and ambient lengths of the respective two antennas are either the same or different from each other;

said two antennas are arranged in a location where they become substantially axi-symmetric;

feeding points are connected to each antenna, and each of said two antennas includes metal plates electrically short-circuited with said ground plate;

said slits are disposed in said metal plates at least at one place; and a switching circuit capable of electrically connecting an open end of the slit is connected to said slit.

14. The antenna for mobile wireless communications according to claim 3, wherein said switching circuit is configured by a series resonance circuit.

15. The antenna for mobile wireless communications according to claim 13, wherein said switching circuit is configured by a parallel resonance circuit.

16. The antenna for mobile wireless communications according to any of claim 1 to 7, claim 10, or claim 13 to 15, wherein said two antenna are formed on a dielectric substrate.

17. The antenna for mobile wireless communications according to any one of claim 1 to 7, claim 10, or claim 13 to 15, wherein an operating frequency band is above UHF band.

18. A portable-type wireless apparatus, comprising an antenna for mobile wireless communications according to any one of claim 3 to claim 7, claim 10, or claim 13 to 15 using said ground plane as a ground plate on a dielectric circuit substrate having a ground plane, wherein said dielectric circuit substrate and said antennas or antenna elements are covered with a case made of resin.

19. An antenna for mobile wireless communications comprising:

a conductive ground plate of a substantially rectangular shape;

a dielectric substrate arranged on said conductive ground plate in close vicinity to an end portion side of both end portions using a center of the longitudinal conductive ground plate as a reference; and two antenna elements of a substantially rectangular shape formed on said dielectric substrate;

wherein each of said two antennas has a feeding point and at least one through-hole and is electrically short-circuited with said conductive ground plate via the through-hole, and the difference of feeding phases for said two antenna elements is substantially 180 degrees.

20. The antenna for mobile wireless communications according to claim 19, wherein each said feeding point and each said through-hole is arranged in the location where either of them becomes axi-symmetric.

21. The antenna for mobile wireless communications according to claim 19, wherein a distance between said two antennas or a distance between said two antenna elements is a length not greater than one-tenth of a wavelength corresponding to a length which is substantially two times an ambient length of each said antenna or each said antenna element.

22. An antenna for mobile wireless communications comprising:

a conductive ground plate of a substantially rectangular shape;

a dielectric substrate arranged on said conductive ground plate in close vicinity to an end portion side of both end portions using a center of the longitudinal conductive ground plate as a reference; and two antenna elements of a substantially rectangular shape formed on said dielectric substrate;

wherein each of said two antennas has a feeding point and at least one through-hole and is electrically short-circuited with said conductive ground plate via the through-hole, and said two antenna elements are substantially of an axi-symmetric structure.

23. The antenna for mobile wireless communications according to claim 22, wherein each said feeding point and each said through-hole is arranged at the location where either of them becomes axi-symmetric.

24. The antenna for mobile wireless communications according to claim 22, wherein a distance between said two antennas or a distance between said two antenna elements is a length not greater than one-tenth of a wavelength corresponding to a length which is substantially two times an ambient length of each said antenna or each said antenna element.

25. An antenna for mobile wireless communications comprising:

a conductive ground plate of a substantially rectangular shape; dielectric substrate arranged on said conductive ground plate in close vicinity to an end portion side of both end portions using a center of the longitudinal conductive ground plate as a reference; and two antenna elements of a substantially rectangular shape formed on said dielectric substrate;

wherein each of said two antennas has a feeding point and at least one through-hole and is electrically short-circuited with said conductive ground plate via The through-hole, and each of said feeding point and through-hole are arranged at a location where either of them becomes axi-symmetric.

26. The antenna for mobile wireless communications according to any one of claims 19–25, further comprising a balance-to-unbalance circuit for feeding said two antennas or said two antenna elements.

27. The antenna for mobile wireless communications according to any one of claim 19 to 21 or claim 23 to 26, wherein an operating frequency band is above UHF band.

28. A portable-type wireless apparatus, comprising an antenna for mobile wireless communications according to any one of claim 19 to 21 or claim 23 to claim 26 using said ground plane as a ground plate on a dielectric circuit substrate having a ground plane, wherein said dielectric circuit substrate and said antenna or antenna elements are covered with a case of resin.

29. An antenna for mobile wireless communications comprising two antennas, each having a substantially (1) rectangular shape, (2) circular shape, or (3) polygonal shape having a single on a plurality of slits, wherein feeding phases for said two antennas are substantially different from each other;

said two antennas are arranged in close vicinity to a ground plate feeding points are connected to each antenna, and each of said two antennas includes a metal plate electrically short-circuited with said ground plate;

said metal plate is of a rectangular shape and each portion of said two metal plates arranged in a substantially axi-symmetric location is electrically short-circuited with said ground plate in close vicinity to an outer peripheral portion of said metal plate; and said two antennas are arranged by inclining to one of both sides with a central portion of said ground plate as a reference; and said portion and feeding point are arranged in close vicinity to said one side.

30. An antenna for mobile wireless communications comprising two antennas, each having a substantially (1) rectangular shape, (2) circular shape, or (3) polygonal shape having a single or a plurality of slits, wherein feeding phases for said two antennas are substantially different from each other;

said two antennas are arranged in close vicinity to a ground plate feeding points are connected to each antenna, and each of said two antennas includes a metal plate electrically short-circuited with said ground plate;

said metal plate is of a rectangular shape and each portion of said two metal plates arranged in a substantially axi-symmetric location is electrically short-circuited with said ground plate in close vicinity to an outer peripheral portion of said metal plate; and said two antennas are formed on a dielectric.

31. The antenna for mobile wireless communications according to any one of claim 8, 9, 11, 12, 29, or 30, wherein an operating frequency band is above UHF band.

32. A portable-type wireless apparatus, comprising an antenna for mobile wireless communications according to any one of claim 8, 9, 11, 12, 29, or 30, using said ground plane as a ground plate on a dielectric circuit substrate having a ground plane, wherein said dielectric circuit substrate and said antennas or antenna elements are covered with a case made of resin.

* * * * *

UNITED STATES PATENT AND TRADEMARK OFFICE

CERTIFICATE OF CORRECTION

PATENT NO. : 6,549,169 B1
DATED : April 15, 2003
INVENTOR(S) : Matsuyoshi et al.

It is certified that error appears in the above-identified patent and that said Letters Patent is hereby corrected as shown below:

Column 19,
Line 22, “arrange” should read -- arranged --.
Line 39, after “claim” insert -- 6 --.
Line 49, after “claim” insert -- 8 --.

Column 20,
Line 29, “3” should read -- 13 --.

Column 21,
Line 49, “The” should read -- the --.

Column 22,
Line 3, “19 to 21 or claim 23 to claim 26” should read -- 19-25 --.
Line 12, “on” should read -- or --.
Lines 16 and 38, after “plate” insert a comma -- , --.

Signed and Sealed this

Thirty-first Day of August, 2004

JON W. DUDAS
*Director of the United States Patent and Trademark Office*